US008031162B2

(12) United States Patent
Kuroki

(10) Patent No.: US 8,031,162 B2
(45) Date of Patent: Oct. 4, 2011

(54) DISPLAY DEVICE AND METHOD, RECORDING MEDIUM, AND PROGRAM

(75) Inventor: Yoshihiko Kuroki, Kanagawa (JP)

(73) Assignee: Sony Corporation, Tokyo (JP)

( * ) Notice: Subject to any disclaimer, the term of this patent is extended or adjusted under 35 U.S.C. 154(b) by 538 days.

(21) Appl. No.: 10/570,508

(22) PCT Filed: Jun. 1, 2005

(86) PCT No.: PCT/JP2005/010048

§ 371 (c)(1),
(2), (4) Date: Feb. 8, 2007

(87) PCT Pub. No.: WO2006/006315

PCT Pub. Date: Jan. 19, 2006

(65) Prior Publication Data

US 2008/0094344 A1 Apr. 24, 2008

(30) Foreign Application Priority Data

Jul. 13, 2004 (JP) ..... 2004-206338

(51) Int. Cl.
*G09G 3/36* (2006.01)

(52) U.S. Cl. ..... 345/102; 345/204

(58) Field of Classification Search ..... 345/102, 345/87, 204, 690

See application file for complete search history.

(56) References Cited

U.S. PATENT DOCUMENTS

| | | | | |
|---|---|---|---|---|
| 5,337,068 | A * | 8/1994 | Stewart et al. | 345/88 |
| 5,592,193 | A * | 1/1997 | Chen | 345/102 |
| 6,448,951 | B1 * | 9/2002 | Sakaguchi et al. | 345/88 |
| 6,456,266 | B1 | 9/2002 | Iba et al. | |
| 6,762,742 | B2 * | 7/2004 | Moon et al. | 345/102 |
| 6,803,901 | B1 * | 10/2004 | Numao | 345/102 |
| 6,870,525 | B2 * | 3/2005 | Kawabata et al. | 345/102 |
| 6,956,555 | B2 * | 10/2005 | Kyomoto | 345/102 |
| 7,113,163 | B2 * | 9/2006 | Nitta et al. | 345/102 |
| 2002/0008694 | A1 | 1/2002 | Miyachi et al. | |
| 2002/0057238 | A1 | 5/2002 | Nitta et al. | |
| 2002/0067332 | A1 * | 6/2002 | Hirakata et al. | 345/102 |

FOREIGN PATENT DOCUMENTS

EP 1 091 341 A2 4/2001

(Continued)

OTHER PUBLICATIONS

English translation of the international preliminary report for PCT/JP2005/010048 dated Jan. 25, 2007.

(Continued)

*Primary Examiner* — Stephen Sherman

(74) *Attorney, Agent, or Firm* — Rader, Fishman & Grauer PLLC

(57) ABSTRACT

The present invention relates to display devices and methods, recording media, and programs that allow moving images to be displayed with less double vision. An LCD 11 updates the display in the order of the columns or rows of pixels on the screen in units of column or row in each period of a frame. LED backlights 12-1 to 12-N illuminate the pixels of the LCD 11, respectively, so as to illuminate part of all the columns or rows on the screen. A display control section 31 controls the light emission of the LED backlights 12-1 to 12-N in a manner such that the LED backlights 12-1 to 12-N illuminate the pixels updated in sequence in each period of the frame. The invention can be applied to display devices.

7 Claims, 17 Drawing Sheets

FOREIGN PATENT DOCUMENTS

| | | | |
|---|---|---|---|
| EP | 1 164 566 | A2 | 12/2001 |
| JP | 64-082019 | A | 3/1989 |
| JP | 11-202285 | A | 7/1999 |
| JP | 2000-019486 | A | 1/2000 |
| JP | 2000-275604 | A | 10/2000 |
| JP | 2001-125067 | A | 5/2001 |
| JP | 2002-072988 | A | 3/2002 |
| JP | 2002-105447 | A | 4/2002 |
| JP | 2002-156950 | A | 5/2002 |

OTHER PUBLICATIONS

PCT International Search Report for PCT/JP2005/010048 mailed on Jul. 5, 2005.

Japanese Office Action dated Feb. 21, 2008 for corresponding Japanese Application No. 2004-206338.

Supplementary European Search Report issued Jul. 20, 2009 for corresponding European Application No. 05 74 5960.

* cited by examiner

DISPLAY DEVICE AND METHOD, RECORDING MEDIUM, AND PROGRAM

TECHNICAL FIELD

The present invention relates to display devices and methods, recording media, and programs and, in particular, it relates to display devices and methods, recording media, and programs suitable for displaying moving images.

BACKGROUND ART

In general, the number of frames (fields) displayed in one second by the known national television system committee (NTSC) system and high-definition (HD) television system is 60 (more precisely, 59.94 frames per second).

The number of frames displayed in one second is referred to as a frame rate.

The frame rate of display devices of a phase-alternating-by-line (PAL) system is 50 frames per second. The frame rate of movies is 24 frames per second.

Moving images displayed in 60 to 24 frames per second may suffer from degradation in quality, such as blur, motion blur, and jerkiness. Particularly, what-is-called hold-type display devices that hold display for the period of frames are quite susceptible to motion blur.

A known display device compares display data with preceding display data and, for pixels that have changed in value, writes display data enhanced more than the amount of change to change the value of the pixels more than that of the preceding display data, thus controlling the period and time to light on light sources for each region of an illuminator having multiple regions (for example, refer to Patent Document 1).

Another example is a liquid display device that displays video images on a liquid display panel by controlling the light of a fluorescent lamp having red-, green-, and blue-light emitting phosphor coatings by modulating the pulse width through a lighting circuit, writing video signals on a liquid crystal panel, and using the fluorescent lamp as a backlight of the liquid crystal panel. The fluorescent lamp has a green-light-emitting phosphor coating in which the amount of light after light-off becomes one tenth of that during light-on for one millisecond or less (for example, refer to Patent Document 2)

[Patent Document 1] Japanese Unexamined Patent Application Publication No. 2001-125067

[Patent Document 2] Japanese Unexamined Patent Application Publication No. 2002-105447

DISCLOSURE OF INVENTION

Problems to be Solved by the Invention

When hold-type direct-view liquid crystal display devices (LCDs) display an image (image object) moving on the display screen, motion blur is perceived. The motion blur is caused by the displacement of an image formed on an eye's retina, which is called retinal slip (Handbook of Vision Information Processing, The Vision Society of Japan, Asakura Shoten, p. 393)) in visual tracking of tracking an image (image object) moving on the display screen with eyes. Much motion blur is perceived on general images including a moving image object, which is displayed at a frame rate of 60 or less per second.

In order to reduce the motion blur, it is proposed to make the entire screen illuminate in pulse form (in rectangular waveform relative to time) in a shorter time than the time during which one frame is displayed. However, such display causes jerkiness in which the motion of a fast-moving image object appears discontinuous (jerky) in fixed viewing of viewing a displayed image with a fixed line of sight.

Furthermore, there may be a case in which a moving image object is viewed double, depending on the method of updating the screen display.

The screen display of LCD devices is generally updated in a line sequential manner. That is, in LCD devices, the display is updated in the order of the rows from the top of the screen to the bottom in units of pixels in the row of the screen. This system is called a what-is-called line sequential system.

Since the response speed of liquid crystal used in direct-view liquid crystal displays is low, it may need a period of about one frame to update the display of all the pixels of the screen. In other words, the display of the pixels of direct-view LCD devices is updated in sequence in one cycle of a vertical sync signal.

Accordingly, at a specified time of one frame, the pixels in a specified region of the screen sometimes display the image of the present frame, while the pixels of the other region of the screen sometimes display the image of the preceding frame.

As has been described, when light sources are illuminated in pulse form at the same timing over the entire screen in a shorter time, images in different frames are enhanced, posing the problem that a moving image object is viewed double.

The invention has been made in consideration of such circumstances. Accordingly, it is an object of the invention to provide a display device, which updates display in line sequential manner, capable of displaying a moving image with less double vision.

Means for Solving the Problems

A display device according to a first aspect of the invention includes: display means that updates the display in the order of the columns or rows of pixels on the screen in units of column or row in each period of a frame; a plurality of light sources illuminating the pixels of the display means, respectively, so as to illuminate part of all the columns or rows on the screen; and control means controlling the light emission of the light sources in a manner such that the light sources illuminate the pixels updated in sequence in each period of the frame.

The control means may include: sync-signal generating means generating a sync signal for synchronization with the frame; light-emission-indication-signal generating means generating a plurality of light-emission indication signals for the light sources on the basis of the sync signal, respectively, the light-emission indication signals being delayed from the time when frame starts in accordance with the number of the light sources; and a plurality of light-emission control means controlling the light emission of the light sources in response to the light-emission indication signals on a one-to-one basis.

The control means may further include waveform shaping means that shapes the waveform of the light-emission indication signals so that the values of the light-emission indication signals change with the passage of time. The light-emission control means may control the light emission of the light sources so as to change the intensity of the light emission of the light sources in accordance with the values of the shaped light-emission indication signals.

The light-emission-indication-signal generating means may generate the plurality of light-emission indication signals for the light sources, respectively, the light-emission indication signals being delayed in accordance with the number of the light sources with reference to the time after a lapse of a specified time from the frame-starting time.

A display method according to a second aspect of the invention is a display method for a display device including: display means that updates the display in the order of the columns or rows of pixels on the screen in units of column or row in each period of a frame; and a plurality of light sources illuminating the pixels of the display means, respectively, so as to illuminate part of all the columns or rows on the screen. The method includes a control step of controlling the light emission of the light sources in a manner such that the light sources illuminate the pixels updated in sequence in each period of the frame.

A program in a recording medium according to a third aspect of the invention is a program for controlling the display of a display device including: display means that updates the display in the order of the columns or rows of pixels on the screen in units of column or row in each period of a frame; and a plurality of light sources illuminating the pixels of the display means, respectively, so as to illuminate part of all the columns or rows on the screen. The program includes a control step of controlling the light emission of the light sources in a manner such that the light sources illuminate the pixels updated in sequence in each period of the frame.

A program according to a fourth aspect of the invention is a program for a computer to execute the process of controlling the display of a display device including: display means that updates the display in the order of the columns or rows of pixels on the screen in units of column or row in each period of a frame; and a plurality of light sources illuminating the pixels of the display means, respectively, so as to illuminate part of all the columns or rows on the screen. The program includes a control step of controlling the light emission of the light sources in a manner such that the light sources illuminate the pixels updated in sequence in each period of the frame.

With the display method, recording medium, and program according to embodiments of the invention, the light emission of the light sources is controlled in a manner such that the light sources illuminate the pixels updated in sequence in each period of a frame.

The display device may be an independent device or, alternatively, a block for display processing.

Advantages

In accordance with an embodiment of the invention, images can be displayed.

In accordance with an embodiment of the invention, moving images can be displayed with less double vision.

REFERENCE NUMERALS

11: LCD, 12-1-1 to 12-9-2, 12, 12-1 to 12-N: LED backlight, 31: display control section, 41: sync-signal extracting section, 42: pulse-signal generating section, 43-1 to 43-N, 43: current-control section, 51: magnetic disk, 52: optical disk, 53: magneto-optical disk, 54: semiconductor memory, 81: display control section, 91-1 to 91-N, 91: CR circuit, 121-1 to 121-13, 121, 121-1 to 121-N: cold-cathode tube, 141: display control section, 161: pulse-signal generating section, 162-1 to 162-N, 162: inverter

BEST MODE FOR CARRYING OUT THE INVENTION

Figure 1:
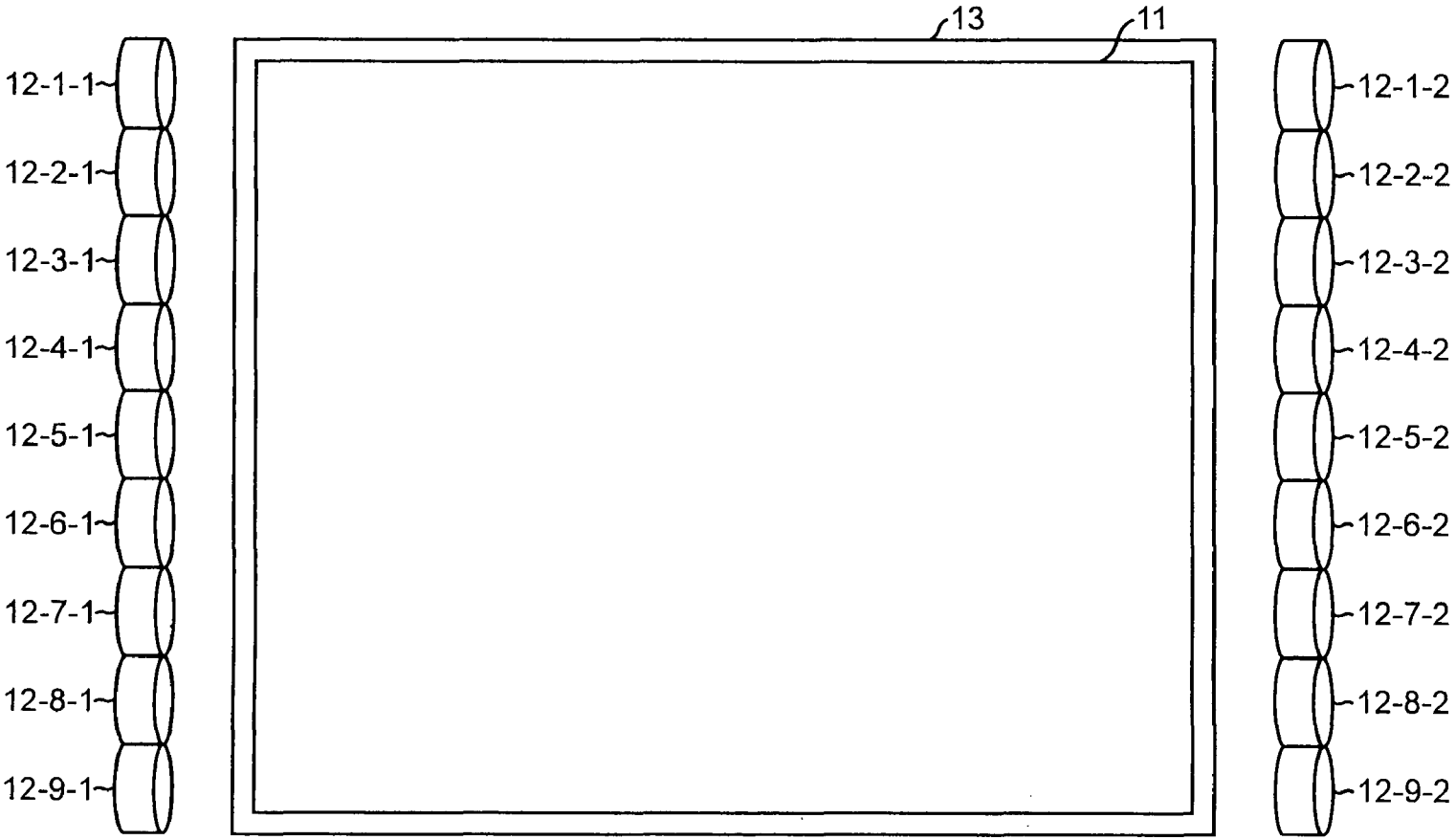
FIG. 1 is a diagram showing a configuration of a display device according to an embodiment of the invention.

FIG. 1 is a diagram showing the configuration of a display device according to an embodiment of the invention. A liquid crystal display (LCD) 11 is a what-is-called direct-view liquid crystal display device. The LCD 11 is an example of a display device that updates the display in the order from the top to the bottom in units of pixels in the row of the screen in each period of the frame.

For example, the LCD 11 updates the display of all the pixels of the screen in the period of one frame. Specifically, the LCD 11 updates the display of the pixels of the uppermost row on the screen directly after the time at which the frame starts. The LCD 11 thereafter updates the display of the pixels of each row in the order from the top to the bottom. The LCD 11 then updates the pixels in the lowermost row on the screen directly before the time the frame ends.

Light-emitting-diode (LED) backlights 12-1-1 to 12-9-2 are examples of the light source of the display device.

For example, the LED backlights 12-1-1 to 12-9-2 include one or a plurality of red LEDs that emit red light, one or a plurality of green LEDs that emit green light, and one or a plurality of blue LEDs that emit blue light. In other words, the LED backlights 12-1-1 to 12-9-2 emit light including red light, green light, and blue light that are the three primary colors of light.

The LED backlights 12-1-1 to 12-9-2 may be white LEDs that emits white light containing red light, green light, and blue light.

For example, red LEDs, green LEDs, and blue LEDs may be arranged in order in a manner such that the LED backlights 12-1-1, 12-1-2, 12-4-1, 12-4-2, 12-7-1, and 12-7-2 have a red LED that emits red light; the LED backlights 12-2-1, 12-2-2, 12-5-1 12-5-2, 12-8-1, and 12-8-2 have a green LED that emits green light; and the LED backlights 12-3-1, 12-3-2, 12-6-1, 12-6-2, 12-9-1, and 12-9-2 have a blue LED that emits blue light.

The light emitted from the LED backlights 12-1-1 to 12-9-2 is guided by an optical waveguide 13, and is evenly diffused into the back of the LCD 11.

The light incident on the back of the LCD 11 passes through the LCD 11, and enters the eyes of a person who is viewing the LCD 11.

In other words, the pixels of the LCD 11 allows light with a specified intensity (of a specified ratio) and wavelength (color light) of the light emitted from the LED backlights 12-1-1 to 12-9-2 to pass through. Since the color light with a specified intensity that has passed through the pixels of the LCD 11 is incident on the eyes of a person who is viewing the LCD 11, the person can perceive an image displayed on the LCD 11.

As has been described, since the LCD 11 updates the display in the order from the top to the bottom in units of pixels in the row of the screen in each period of the frame, the optimum timing at which the pixels of the LCD 11 are illuminated depends on the vertical position of the pixels on the screen.

Here the LED backlights 12-1-1 to 12-9-2 will be described more specifically.

For example, the LED backlights 12-1-1, 12-2-1, 12-3-1, 12-4-1, 12-5-1, 12-6-1, 12-7-1, 12-8-1, and 12-9-1 are arranged on the left of the LCD 11 in FIG. 1. The LED backlights 12-1-2, 12-2-2, 12-3-2, 12-4-2, 12-5-2, 12-6-2, 12-7-2, 12-8-2, and 12-9-2 are arranged on the right of the LCD 11 in FIG. 1.

The LED backlights 12-1-1 and 12-1-2 emit light at the same time to illuminate the pixels in one or a plurality of upper rows in FIG. 1, out of all the rows on the screen of the LCD 11, from the back of the LCD 11. Here the row is the unit of update of the display.

The LED backlights 12-2-1 and 12-2-2 emit light at the same time to illuminate the pixels in one or a plurality of rows lower than those in the one or plurality of rows illuminated by the LED backlights 12-1-1 and 12-1-2 in FIG. 1, out of all the rows on the screen of the LCD 11, from the back of the LCD 11. The row is the unit of update of the display.

The LED backlights 12-3-1 and 12-3-2 emit light at the same time to illuminate the pixels in one or a plurality of rows lower than those in the one or plurality of rows illuminated by the LED backlights 12-2-1 and 12-2-2 in FIG. 1, out of all the rows on the screen of the LCD 11, from the back of the LCD 11. The row is the unit of update of the display.

Similarly, the LED backlights 12-4-1 to 12-9-2 opposed with respect to the LCD 11 emit light at the same time.

The LED backlights 12-4-1 to 12-9-2 opposed with respect to the LCD 11 illuminate the pixels of the LCD 11 from the back so as to illuminate part of all the rows on the screen. The row is the unit of update of the display.

In this way, the LED backlights 12-1-1 to 12-9-2 illuminate the pixels of the LCD 11 from the back so as to illuminate part of all the rows on the screen. The row is the unit of update of the display.

For example, in the case where the LCD 11 updates the display laterally in sequence in the period of the frame in units of the pixels in the column of the screen, the LED backlights 12-1-1 to 12-9-2 are disposed on the top or bottom of the LCD 11. In this case, the LED backlights 12-1-1 to 12-9-2 illuminate the pixels of the LCD 11 from the back so as to illuminate each column of all the columns on the screen. Here the column is the unit of update of the display.

Alternatively, the LED backlights 12-1-1 to 12-9-2 may be disposed on the back of the LCD 11.

When there is no need to distinguish the LED backlights 12-1-1 and 12-1-2 from each other, they are simply referred to as LED backlights 12-1. When there is no need to distinguish the LED backlights 12-2-1 and 12-2-2 from each other, they are simply referred to as LED backlights 12-2. Likewise, when there is no need to distinguish the LED backlights 12-3-1 and 12-9-2 from one another which emit light at the same time, they are simply referred to as LED backlights 12-3 to 12-9.

When there is no need to distinguish the LED backlights 12-1-1 and 12-9-2 from one another, they are simply referred to as LED backlights 12.

The number of the LED backlights 12 is not limited to 18, but may be an arbitrary number N. To distinguish them, they are referred to as LED backlights 12-1 to 12-N.

Figure 2:
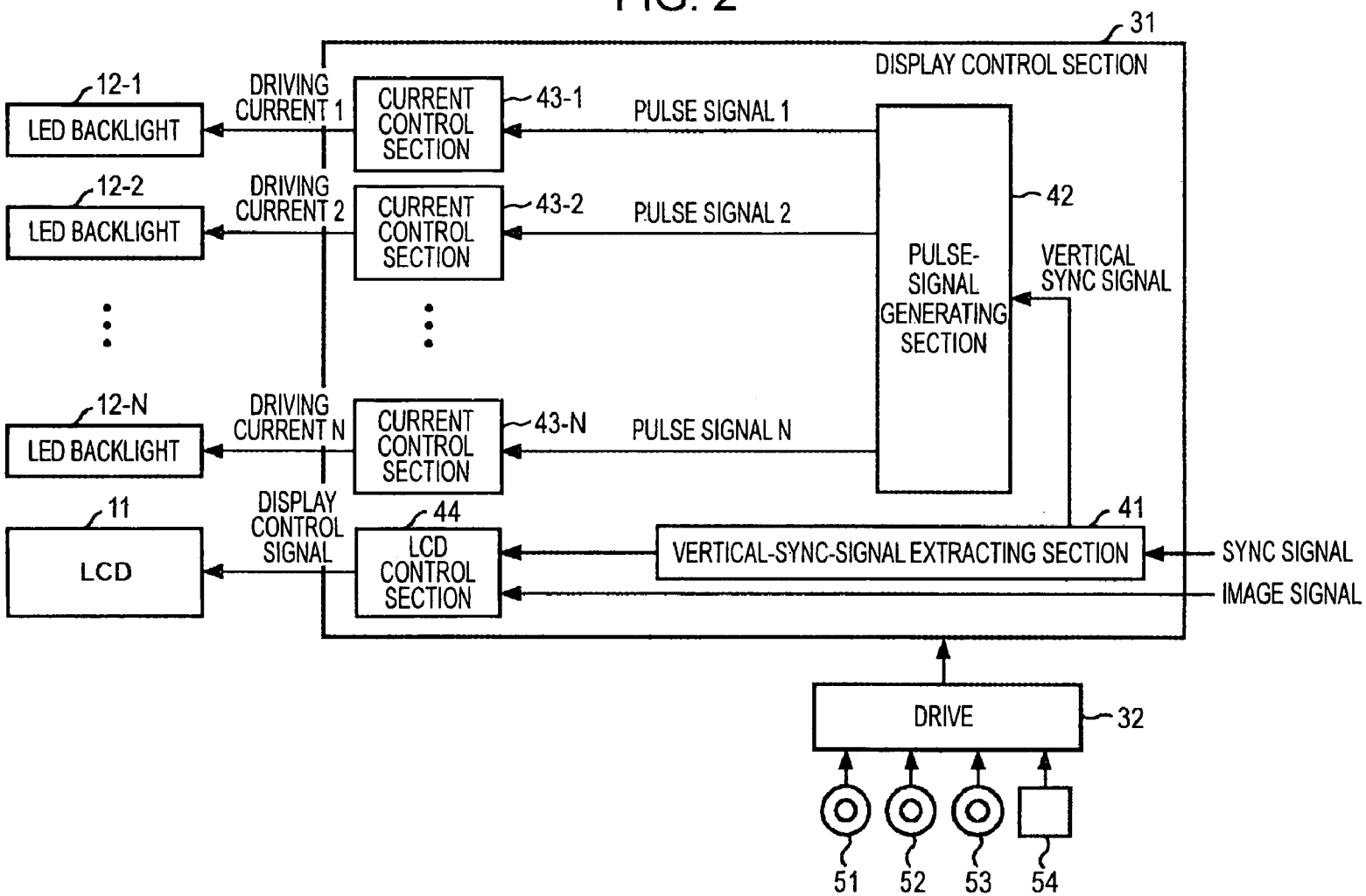
FIG. 2 is a block diagram showing a configuration of a display device according to the invention.

FIG. 2 is a diagram showing a configuration of a display device according to the invention. A display control section 31 controls the display of the LCD 11 and the light emission of the LED backlights 12-1 to 12-N that are examples of a light source. The display control section 31 is achieved by a dedicated circuit such as an application specific integrated circuit (ASIC), a programmable LSI such as a field programmable gate array (FPGA), or a general-purpose microprocessor that executes a control program.

The LCD 11 displays an image under the control of the display control section 31. The LED backlights 12-1 to 12-N emit light under the control of the display control section 31.

The display control section 31 includes a vertical-sync-signal extracting section 41, a pulse-signal generating section 42, current-control sections 43-1 to 43-N, and an LCD control section 44.

A sync signal supplied to the display control section 31 includes a vertical sync signal and a horizontal sync signal, which are supplied to the vertical-sync-signal extracting section 41. An image signal supplied to the display control section 31 is supplied to the LCD control section 44.

The vertical sync signal contained in the sync signal is for synchronization with the frames of a moving image displayed in response to the image signal.

The vertical-sync-signal extracting section 41 extracts (generates) the vertical sync signal from the sync signal supplied from the exterior, and supplies the extracted vertical sync signal to the pulse-signal generating section 42 and the LCD control section 44.

The pulse-signal generating section 42 generates pulse signals for lighting the LED backlights 12-1 to 12-N in synchronization with the vertical sync signal. For example, the pulse-signal generating section 42 generates pulse signals 1 to N that are delayed in accordance with the number N of the LED backlights 12-1 to 12-N on the basis of the vertical sync signal in each period of the frame of the moving image displayed according to the image signal.

Here the pulse signal 1 is a signal for lighting the LED backlight 12-1. The pulse signal 2 is a signal for lighting the LED backlight 12-2. The pulse signal 3 (not shown) to the pulse signal N are signals for lighting the LED backlight 12-3 (not shown) to the LED backlight 12-N, respectively.

Figure 3:
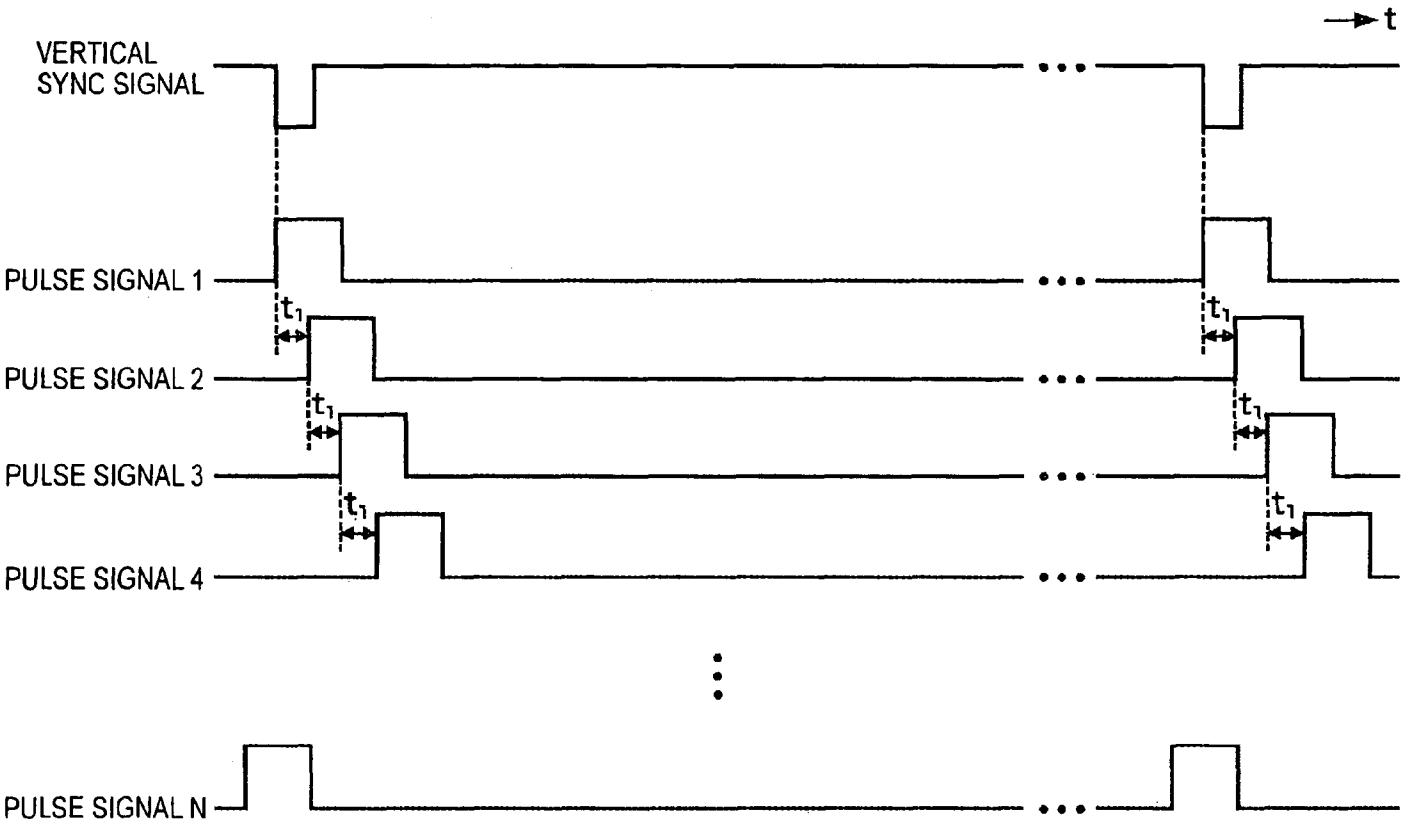
FIG. 3 is a diagram showing an example of pulse signals 1 to N.

FIG. 3 is a diagram showing an example of the pulse signals 1 to N.

For example, as shown in FIG. 3, the pulse signal 1 is a pulse signal with a specified height (peak value) and pulse width, which rises at the time when the frame starts (the time when the vertical sync signal falls).

The height (peak value) and pulse width of the pulse signals 2 to N are equal to those of the pulse signal 1. The pulse signals 2 to N each rise at the time after a lapse of a period corresponding to the number N of the LED backlights 12-1 to 12-N from the rise time of the pulse signal 1.

For example, the period of one frame is expressed as 1/m [s] where m is the frame rate [frame/s]. In this case, when the number of the LED backlights 12 is N, the time t1 that the pulse signal 2 is delayed from the pulse signal 1 is written as 1/(m×(N−1)) [s]. The pulse signal 3 is delayed from the pulse signal 2 by the time t1 that is expressed as 1/(m×(N−1)) [s]. The pulse signal 4 is delayed from the pulse signal 3 by the time t1 that is expressed as 1/(m×(N−1)) [s]. Likewise, the pulse signals 4 to N are each delayed by the time t1 that is expressed as 1/(m×(N−1)) [s].

The time t1 is hereinafter referred to as a delay time.

In other words, when the value of variable k is any of integers 1 to N, a pulse signal k that is any of the pulse signals 1 to N rises at the time after a lapse of (k−1)/(m×(N−1)) from the frame-starting time.

As has been described, the pulse-signal generating section 42 generates pulse signals for lighting the LED backlights 12-1 to 12-N that are delayed according to the number of the LED backlights 12-1 to 12-N in the period of the frame, in response to the vertical sync signal.

The pulse-signal generating section 42 supplies the generated pulse signals to the current-control sections 43-1 to 43-N, respectively.

The current-control section 43-1 converts the pulse signal 1 supplied from the pulse-signal generating section 42 to a driving current 1, and supplies the converted driving current 1 to the LED backlight 12-1, thereby controlling the light emission of the LED backlight 12-1. The value of the driving current 1 supplied from the current-control' section 43-1 to the LED backlight 12-1 corresponds to the voltage of the pulse signal 1 input to the current-control section 43-1.

When the driving current increases in value, the LED backlights 12 illuminate more strongly (increase in brightness); when the driving current decreases in value, the LED backlights 12 illuminate more weakly (decrease in brightness).

That is, the brightness of the LED backlight 12-1 is varied in response to the pulse signal 1 output from the pulse-signal generating section 42. For example, when the pulse-signal generating section 42 outputs a pulse signal 1 with a specified height (peak value) and a specified pulse width, the LED backlight 12-1 emits light at a brightness corresponding to the height (peak value) of the pulse signal 1 during the period corresponding to the pulse width.

Similarly, the current-control section 43-2 converts the pulse signal 2 supplied from the pulse-signal generating section 42 to a driving current 2, and supplies the converted driving current 2 to the LED backlight 12-2, thus controlling the light emission of the LED backlight 12-2. The current-control sections 43-3 to 43-N convert the pulse signals 3 to N supplied from the pulse-signal generating section 42 to driving currents 3 to N, respectively, and supply the converted driving currents 3 to N to the LED backlights 12-3 to 12-N, respectively, thus controlling the light emission of the LED backlights 12-3 to 12-N.

That is, the brightnesses of the LED backlights 12-2 to 12-N are varied in response to the pulse signals 2 to N output from the pulse-signal generating section 42, respectively.

Referring back to FIG. 2, the LCD control section 44 generates a display control signal for displaying an image on the LCD 11 according to the image signal and the sync signal supplied from the exterior, and supplies the generated display control signal to the LCD 11. Thus the LCD 11 displays an image corresponding to the image signal supplied from the exterior.

A drive 32, which is connected to the display control section 31, as required, reads a program or data recorded in a magnetic disk 51, an optical disk 52, a magneto-optical disk 53, or a semiconductor memory 54, and supplies the read program or data to the display control section 31. The display control section 31 can execute the program supplied from the drive 32.

The display control section 31 may acquire a program via a network (not shown).

As has been described with reference to FIG. 3, when a pulse signal k (k=1 to N) rises at a time after a lapse of a (k−1)/(m×(N−1)) [s] from the frame-starting time, an LED backlight **12-*k* (k=1 to N), which is one of the LED backlights 12-1 to 12**-N, emits light for a period corresponding to the pulse width from the rising time of the pulse signal k.

As has been described, the LCD 11 updates the display of all the pixels of the screen in line sequential manner in the period of one frame, and the LED backlights 12-1 to 12-N are disposed so as to illuminate part of all the rows of the LCD 11, which is the unit of update of the display, from the back. Accordingly, the LED backlights 12-1 to 12-N, when illuminated in that way, illuminate the pixels of the LCD 11 updated in sequence from the back.

Examples of the light emission of the LED backlights 12-1-1 to 12-9-2, shown in FIG. 1, will be described hereinbelow.

Figure 4:
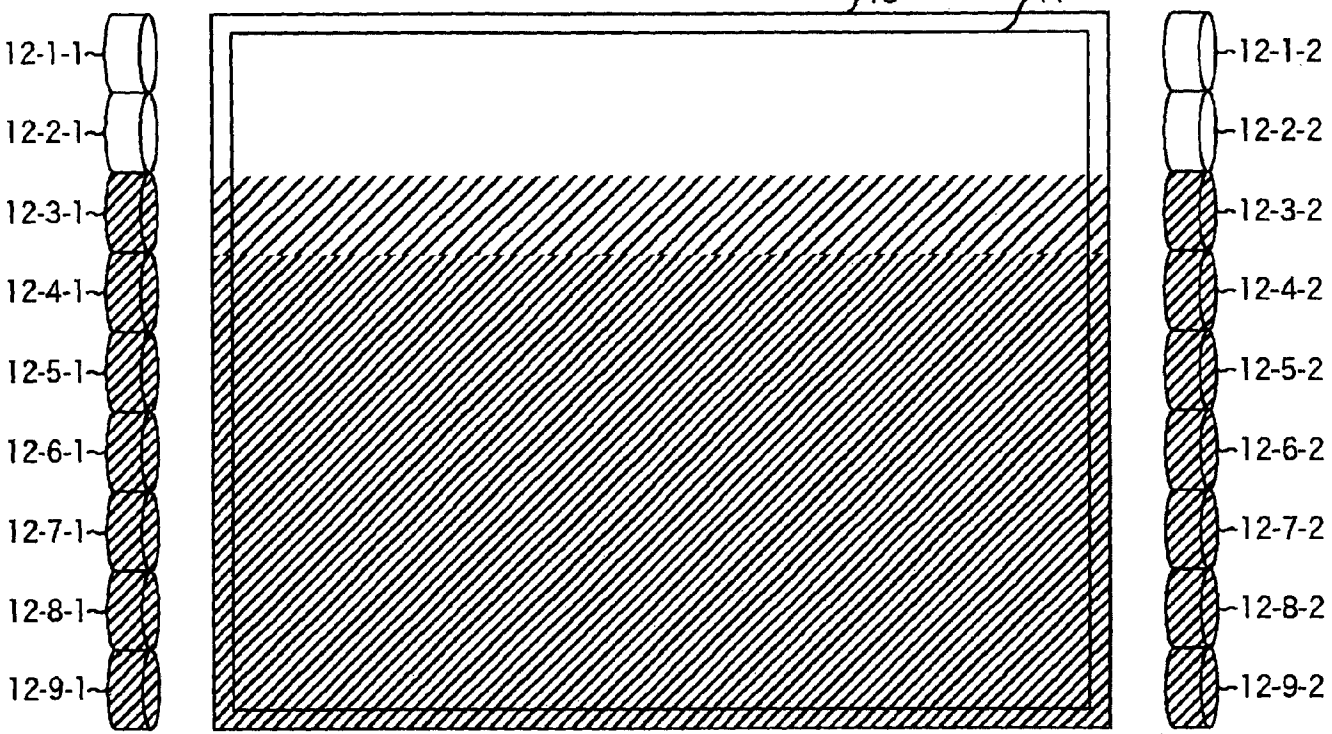
FIG. 4 is an explanatory diagram of an example of light emission of LED backlights.

For example, when the frame rate is set to 60 [frame/s], when the number of the LED backlights 12 is set to 9, and when the width of the pulse signal is set to 1/240 [s], the LED backlights 12-1-1, 12-1-2, 12-2-1, and 12-2-2 emit light at the time after a lapse of delay time t1, that is 1/480 [s], from the time when the vertical sync signal rises, or a frame-starting time, as shown in FIG. 4. At that time, the LED backlights 12-3-1 to 12-9-2 emit no light.

In this example, the delay time t1, that is 1/480 [s], is calculated from 1/(60×(9−1), which is given by substituting the frame rate of 60 and the number 9 of the LED backlights 12 into expression 1/(m×(N−1).

Accordingly, approximately upper two ninths of the whole of the LCD 11 is illuminated by the LED backlights 12-1-1, 12-1-2, 12-2-1, and 12-2-2.

Figure 5:
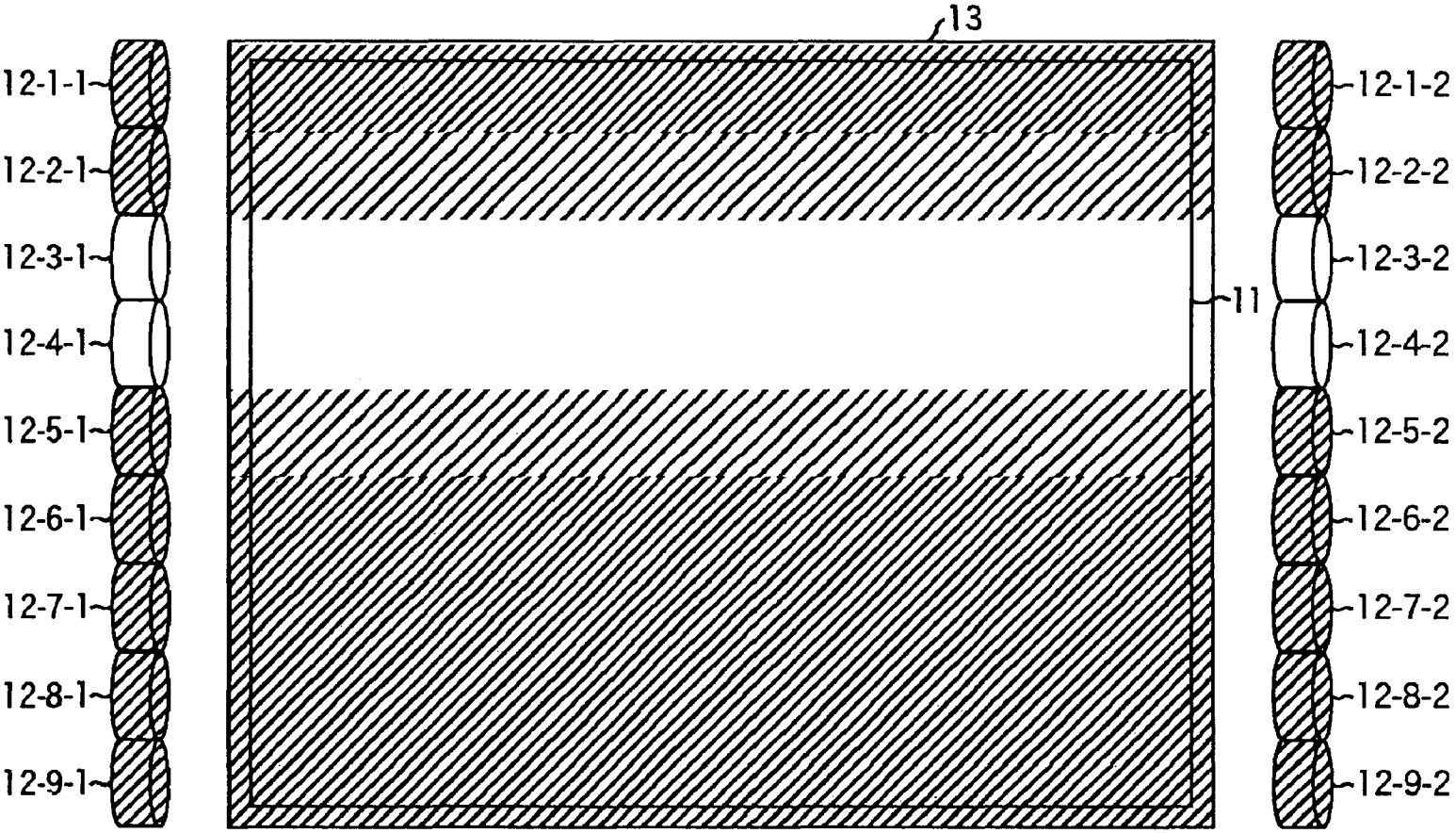
FIG. 5 is an explanatory diagram of an example of light emission of the LED backlights.

As shown in FIG. 5, the LED backlights 12-3-1, 12-3-2, 12-4-1, and 12-4-2 emit light at the time after a lapse of 1/160 [s], which corresponds to three times as long as the delay time t1, from the frame-starting time. At that time, the LED backlights 12-1-1 to 12-2-2, and 12-5-1 to 12-9-2 emit no light.

Accordingly, about two ninths of the entire region of the LCD 11 around a virtual horizontal axis dividing the LCD 11 into upper and lower parts in a proportion of 3 to 6 is illuminated by the LED backlights 12-3-1, 12-3-2, 12-4-1, and 12-4-2.

Figure 6:
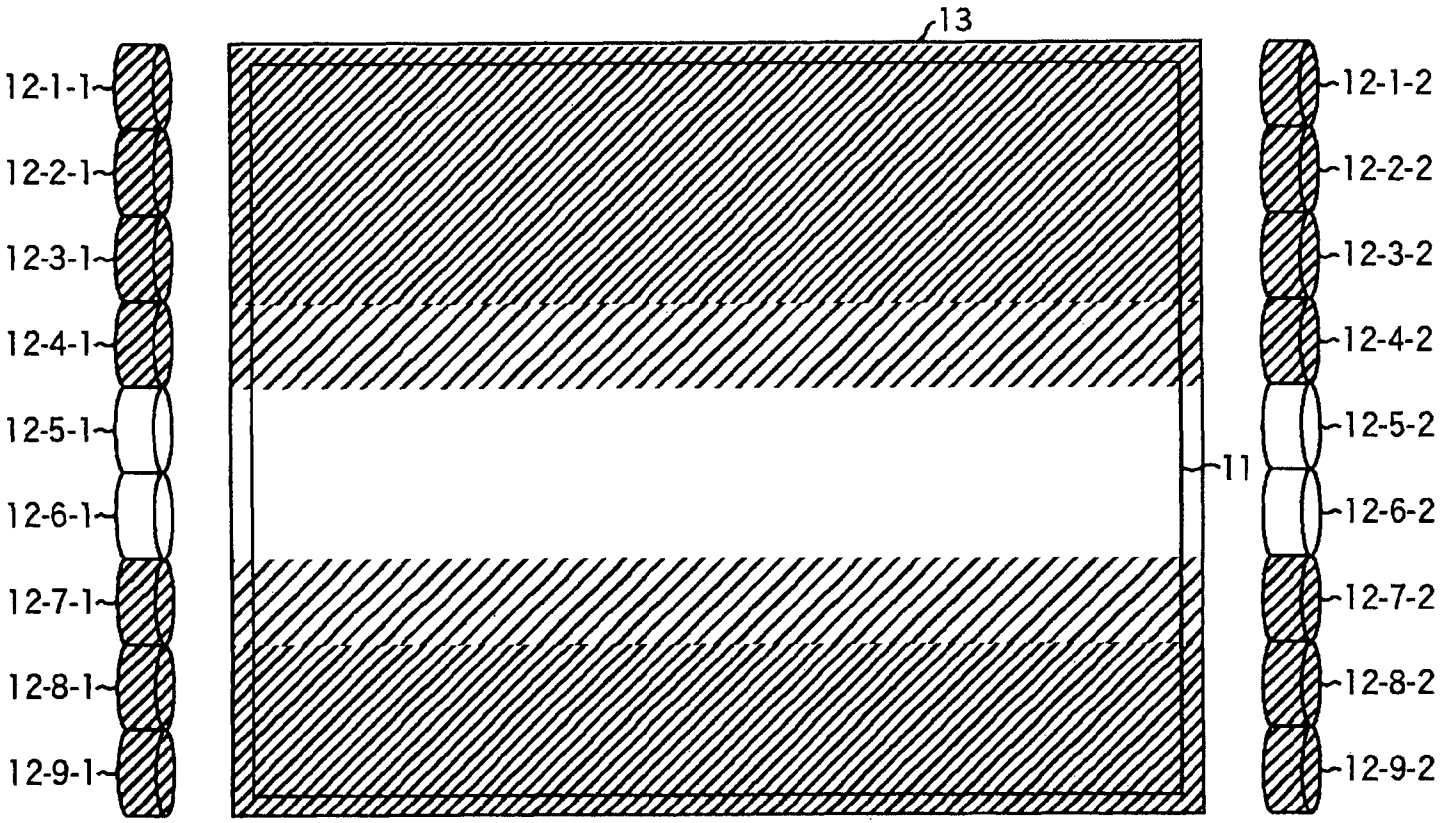
FIG. 6 is an explanatory diagram of an example of light emission of the LED backlights.

AS shown in FIG. 6, the LED backlights 12-5-1, 12-5-2, 12-6-1, and 12-6-2 emit light at the time after a lapse of 1/96 [s], which corresponds to five times as long as the delay time t1, from the frame-starting time. At that time, the LED backlights 12-1-1 to 12-4-2, and 12-7-1 to 12-9-2 emit no light.

Accordingly, about two ninths of the entire region of the LCD 11 around a virtual horizontal axis dividing the LCD 11 into upper and lower parts in a proportion of 5 to 4 is illuminated by the LED backlights 12-5-1, 12-5-2, 12-6-1, and 12-6-2.

Thus the LED backlights 12 illuminate the pixels of the LCD 11 updated, in sequence from the back in each period of the frame. In other words, even if the pixels of a specified region of the LCD 11 display the image of the present frame, and the pixels of the other region of the LCD 11 display the image of the preceding frame at a specified time of the period of one frame, the LED backlights 12 do not illuminate the pixels that display the image of the preceding frame, but illuminate the pixels that display the image of the present frame.

Human eyes generally sense brightness in proportion to the product of luminous intensity and time, as indicated by Block's low (Handbook of Vision Information Processing, The Vision Society of Japan, Asakura Shoten, p. 217). This indicates that a person who is viewing a display device can perceive the image of the present frame from the pixels illuminated by the LED backlights 12, but cannot perceive the image of the preceding frame from the pixels that are not illuminated by the LED backlights 12.

In other word, with the display device of the invention, a person who is viewing the display device can perceive an image from the pixels of the present frame, but cannot perceive an image from the pixels of the preceding frame. Accordingly, the person who is viewing the display device can hardly perceive double vision even if the display device displays a moving image.

As described above, the display device according to the invention can display a moving image from which double vision is hardly perceived.

The pulse-signal generating section 42 may generate pulse signals in sequence on the basis of a predetermine delay time corresponding to the number of the LED backlights 12 or, alternatively, it may acquire the number of LED backlights 12 from an external signal, may calculate delay time from the number of the LED backlights 12, and may generate pulse signals in sequence on the basis of the calculated delay time.

The pulse-signal generating section 42 may generate pulse signals in view of the time required to update the display of the pixels of the LCD 11. More specifically, the time after a lapse of the time required for updating the display of the pixels of one or a specified plurality of rows of the LCD 11 from the frame-starting time is the reference time for generating pulse signals. The pulse-signal generating section 42 generates pulse signals delayed in accordance with the number of LED backlights 12 on the basis of the reference time. This ensures the pixels of the LCD 11 updated to be illuminated in sequence, allowing an image to be displayed with less double vision.

When there is no need to distinguish the current-control sections 43-1 to 43-N from one another, they are simply referred to as current control sections 43.

Referring to the flowchart of FIG. 7, the process of controlling the light emission of the display device according to the invention will be described. In step S11, the pulse-signal generating section 42 determines whether it is the time when a frame is started from whether a vertical sync signal supplied from the vertical-sync-signal extracting section 41 has fallen.

When it is determined in step S11 that it is not a frame-starting time, the process of determination in step S11 is repeated until the frame-starting time comes.

On the other hand, when it is determined in step S11 that it is a frame-starting time, the process proceeds to step S12, wherein the pulse-signal generating section 42 generates a pulse signal. In step S13, the current control section 43 that receives the pulse signal supplies a driving current responsive to the pulse signal to the LED backlight 12 to illuminate the LED backlight 12.

In step S14, the pulse-signal generating section 42 determines whether a predetermined number of pulse signals have been generated by the repeated process of step S12, as will be described later. For example, in step S14, the pulse-signal generating section 42 compares the number of the LED backlights 12 and the number of processes of step S12 to determine whether pulse signals corresponding to the number of the LED backlights 12 have been generated.

When it is determined in step S14 that the predetermined number of pulse signals have not been generated, this indicates that there is LED backlights 12 that have not been lit. Thus the process moves to step S15, wherein the pulse-signal generating section 42 determines whether a predetermined delay time t1 has passed after pulse signals have been generated in step S12. For example, in step S15, the pulse-signal generating section 42 determines whether delay time t1 has passed from the rising time of the pulse signal generated in step S12.

When it is determined in step S15 that delay time t1 has not passed after pulse signals were generated in step S12, there is yet no need to generate the following pulse signal. Accordingly, the process of determination of step S15 is repeated until delay time t1 passes after pulse signals were generated by the process of step S12.

On the other hand, when it is determined in step S15 that delay time t1 has passed after pulse signals were generated in step S12, the procedure returns to step S15 to generate the following pulse signals, and the foregoing process is repeated.

In this way, when pulse signals are generated at a frame-starting time, and after delay time t1 has passed from the time the pulse signals were generated, the following pulse signals are generated in sequence.

On the other hand, when it is determined in step S14 that a predetermined number of pulse signals have been generated, this indicates that all the LED backlights 12 have been lit. Thus the procedure returns to step S11, where the foregoing process is repeated.

When delay time t1 has passed from the time when pulse signals were generated, and after the process of generating the following pulse signals is repeated to generate pulse signals corresponding to the number of the LED backlights 12, the process of controlling the light emission of the frame ends, and then the process of controlling the light emission of the following frame is performed.

In this way, when pulse signals are generated at a frame-starting time, and after delay time t1 has passed from the time the pulse signals were generated, the following pulse signals are generated in sequence. This process is repeated to generate pulse signals in sequence as many as the number of the LED backlights 12.

Thus the LED backlights 12 emit light every time delay time t1 passes from the frame-starting time. In this case, the LED backlights 12 emit light in sequence in response to the update of the display of the pixels of the LCD 11. Accordingly, the display device can display a moving image from which double vision is hardly perceived.

The light sources may be lit such that the brightness increases or decreases temporally continuously.

Figure 8:
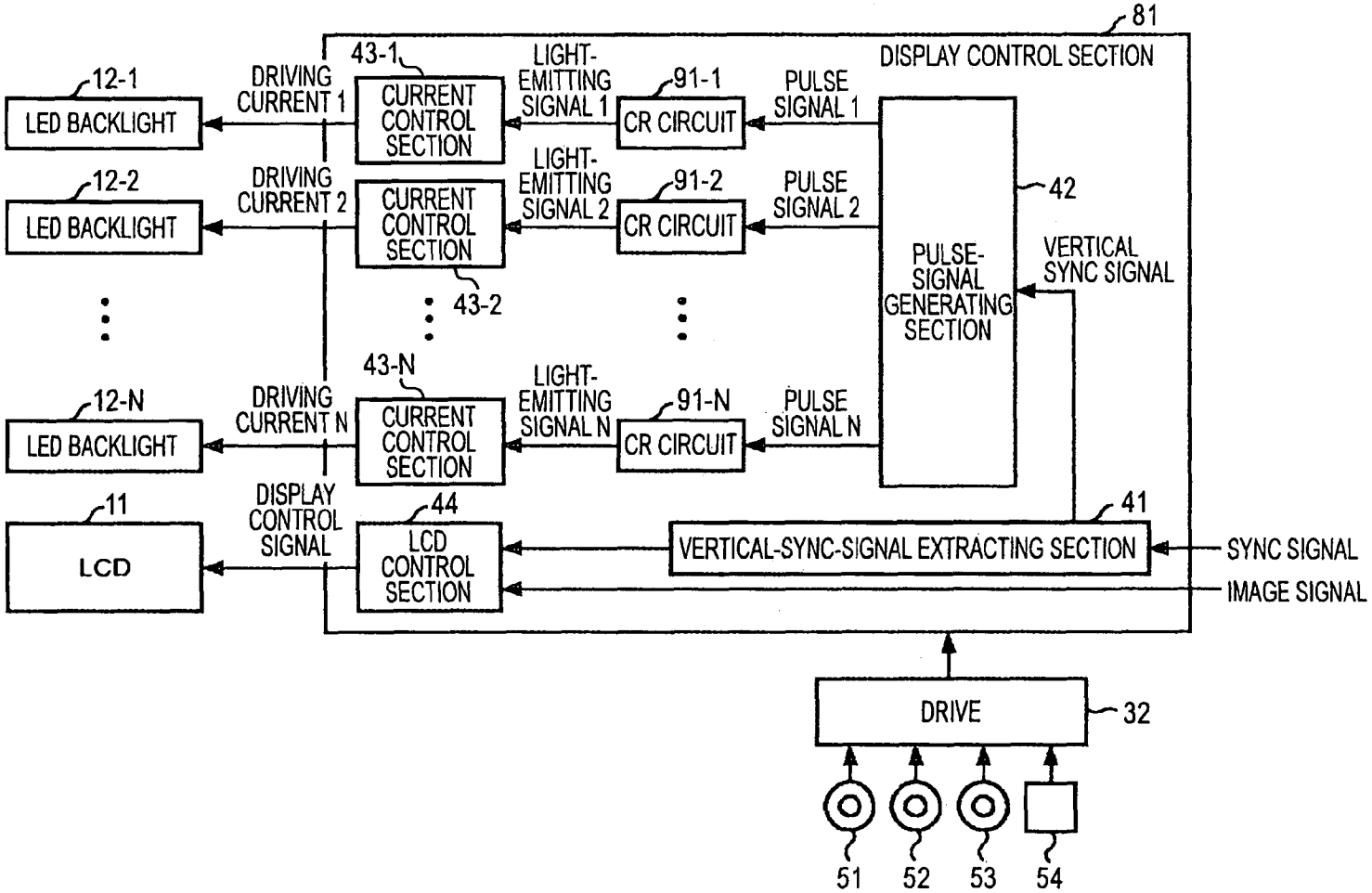
FIG. 8 is a block diagram showing another configuration of the display device according to the invention.

FIG. 8 is a block diagram showing another configuration of the display device according to the invention in which the LED backlights 12-1 to 12-N are lit such that the brightness increases or decreases temporally continuously. The same components as those of FIG. 2 are given the same reference numerals and descriptions thereof will be omitted here.

A display control section 81 controls the display of the LCD 11 and also the light emission of the LED backlights 12-1 to 12-N, which are examples of a light source. The display control section 81 is achieved by a dedicated circuit such as an ASIC, a programmable. LSI such as an FPGA, or a general-purpose microprocessor that executes a control program.

The display control section 81 includes the vertical-sync-signal extracting section 41, the pulse-signal generating section 42, the current-control sections 43-1 to 43-N, the LCD control section 44, and CR circuits 91-1 to 91-N.

The pulse-signal generating section 42 generates pulse signals 1 to N that are delayed in accordance with the number N of the LED backlights 12-1 to 12-N on the basis of the vertical sync signal in each period of the frame of the moving image displayed in response to the image signal, and supplies the generated pulse signals to the CR circuits 91-1 to 91-N.

The CR circuits 91-1 to 91-N are examples of a waveform shaping circuit (time-constant circuit) that shapes the waveform of any of the pulse signals 1 to N in a manner such that it increases or decreases the value of any of the pulse signals 1 to N temporally continuously. The CR circuits 91-1 to 91-N each include a resistor and a capacitor. For example, the CR circuits 91-1 to 91-N have the same circuit configuration and the same time constant.

The CR circuit 91-1 receives the pulse signal 1 supplied from the pulse-signal generating section 42, and shapes the received pulse signal 1 so as to increase or decrease the value temporally continuously. The CR circuit 91-1 then supplies the pulse signal 1 that is shaped to increase or decrease in value temporally continuously to the current-control section 43-1 as a light-emitting signal 1.

The CR circuit 91-2 receives the pulse signal 2 supplied from the pulse-signal generating section 42, and shapes the received pulse signal 2 so as to increase or decrease the value temporally continuously. The CR circuit 91-2 then supplies the pulse signal 2 that is shaped to increase or decrease in value temporally continuously to the current-control section 43-2 as a light-emitting signal 2.

The CR circuit 91-3 (not shown) to the CR circuit 91-N receive the pulse signals 3 to N supplied from the pulse-signal generating section 42, respectively, and shape the received pulse signals 3 to N so as to increase or decrease the values temporally continuously. The CR circuits 91-3 to 91-N supply the pulse signals 3 to N that are shaped to increase or decrease in value temporally continuously to the current-control section 43-3 (not shown) to the current-control section 43-N as light-emitting signals 3 to N, respectively.

The current-control sections 43-1 to 43-N convert the light-emitting signals 1 to N supplied from the CR circuits 91-1 to 91-N to the driving currents 1 to N, respectively, and supply the converted driving currents 1 to N to the LED backlights 12-1 to 12-N, respectively, thereby controlling the light emission of the LED backlights 12-1 to 12-N.

When the CR circuits 91-1 to 91-N output light-emitting signals 1 to N which increase or decrease in value temporally continuously, respectively, the LED backlights 12-1 to 12-N emit light such that the brightness varies temporally continuously in response to the values of the light-emitting signals 1 to N at that time, respectively.

Figure 9:
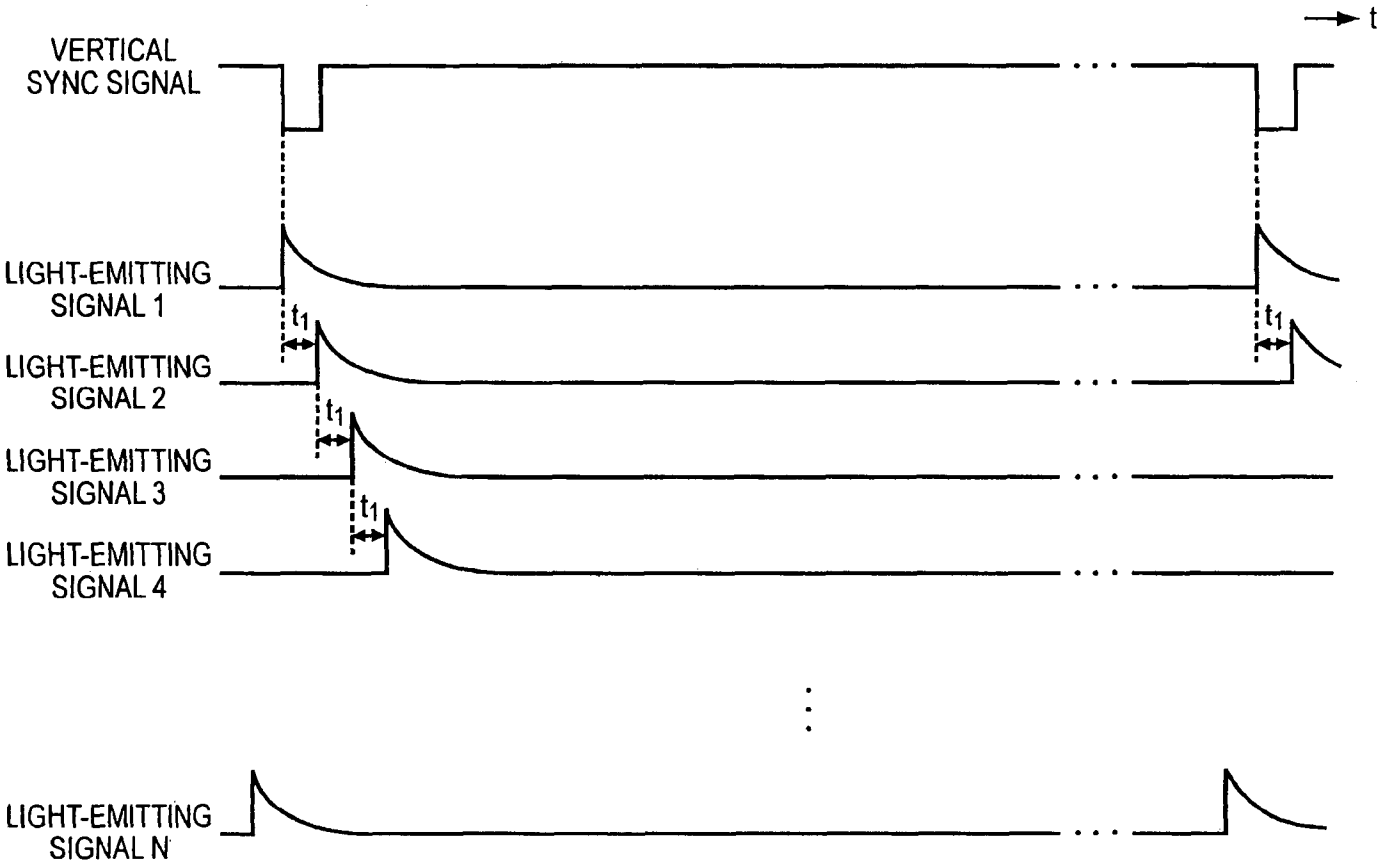
FIG. 9 is an explanatory diagram of an example of light-emitting signals 1 to N.
Figure 10:
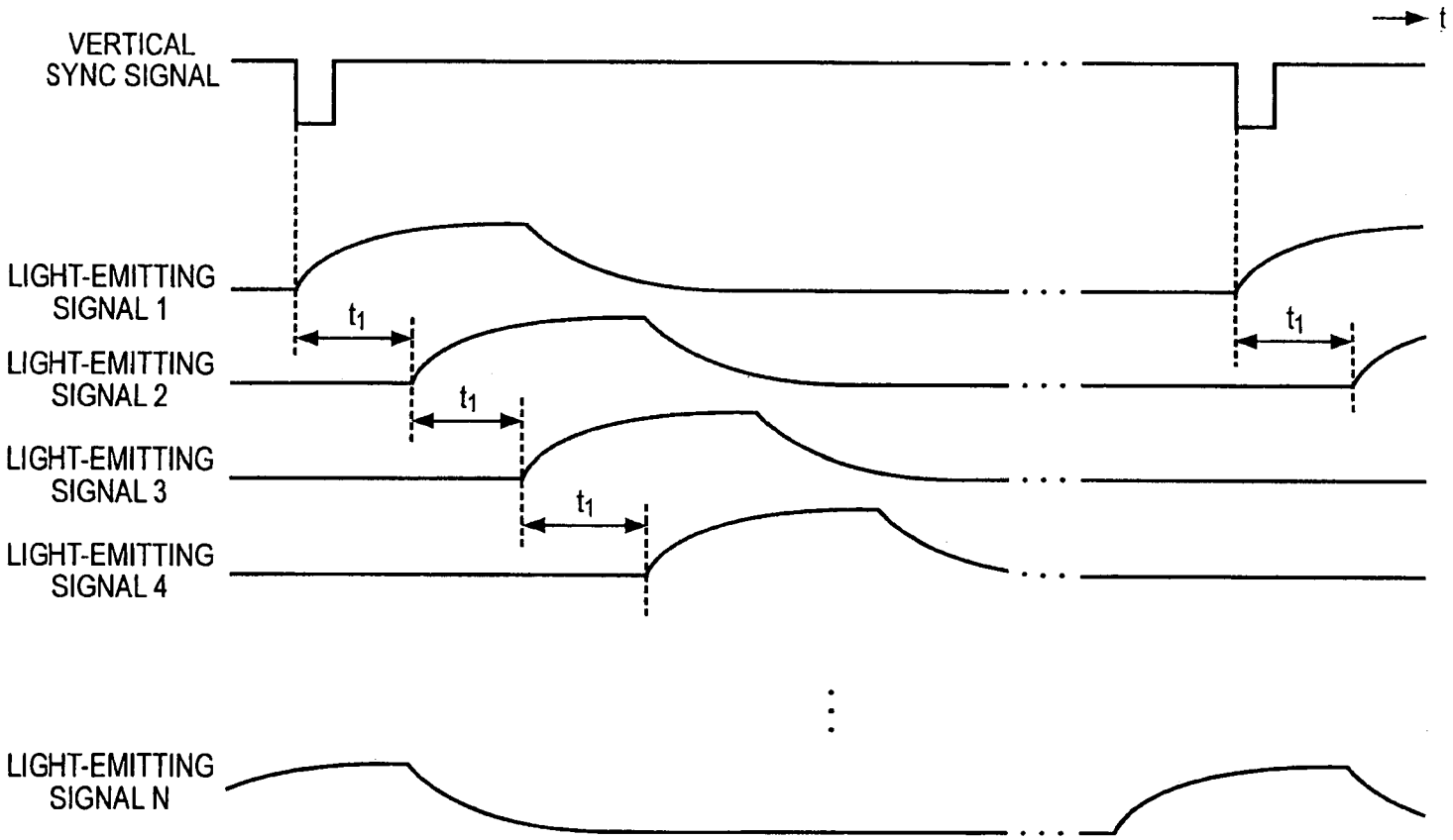
FIG. 10 is an explanatory diagram of another example of the light-emitting signals 1 to N.

Referring now to FIGS. 9 and 10, an example of the light-emitting signals 1 to N will be described.

FIG. 9 is an explanatory diagram of the light-emitting signals 1 to N in the case where the CR circuits 91-1 to 91-N are used as differentiating circuits having a specified time constant, and which differentiate the pulse signals 1 to N, respectively, when the pulse signals 1 to N rise.

As shown in FIG. 9, the light-emitting signal 1 rises at the frame-starting time (the time when the vertical sync signal falls) to the highest, and attenuates exponentially with the passage of time. The light-emitting signal 2 rises at the time after a lapse of delay time t1 from the frame-starting time to the highest, and attenuates exponentially with the passage of time. Similarly, the light-emitting signals 3 to N rise at the time after a lapse of the integer times of delay time t1 from the frame-starting time to the highest, and attenuates exponentially with the passage of time.

In other words, a light-emitting signal k, which is one of the light-emitting signals 1 to N, rises at the time after a lapse of $(k-1)/(m\times N)$ [s] from the frame-starting time to the highest, and attenuates exponentially with the passage of time, where variable k is any of integers 1 to N.

When the light-emitting signals 1 to N, shown in FIG. 9, are generated, the LED backlights 12-1 to 12-N emit light such that they have the maximum brightness at the time after a lapse of $(k-1)/(m\times N)$ [s] from the frame-starting time, and decrease in brightness exponentially with the passage of time.

FIG. 10 is an explanatory diagram of the light-emitting signals 1 to N in the case where the CR circuits 91-1 to 91-N are used as circuits having a specified time constant, and which increases the value and then decreases it exponentially with the passage of time.

As shown in FIG. 10, the light-emitting signal 1 rises from the frame-starting time (the time when the vertical sync signal falls) such that it increases in value exponentially with the passage of time, and then attenuates exponentially after a lapse of a specified time from the rising with the passage of time. The light-emitting signal 2 rises from the time after a lapse of delay time t1 after the frame-starting time such that it increases in value exponentially with the passage of time, and then attenuates exponentially after a lapse of a specified time from the rising with the passage of time. Similarly, the light-emitting signals 3 to N rise from the time after a lapse of the integer times of delay time t1 from the frame-starting time, and after a lapse of a specified time from the rising, it attenuates exponentially with the passage of time.

In other words, a light-emitting signal k, which is any of the light-emitting signals 1 to N, rises so as to increase in value exponentially from the time after a lapse of $(k-1)/(m\times N)$ [s] from the frame-starting time, where variable k is any of integers 1 to N, and attenuates exponentially with the passage of time after a lapse of a specified time from the rising.

When the light-emitting signals 1 to N, shown in FIG. 10, are generated, the LED backlights 12-1 to 12-N emit light so as to increase in brightness exponentially from the time after a lapse of $(k-1)/(m\times(N-1))$ [s] from the frame-starting time, and decrease in brightness exponentially with the passage of time after a lapse of a specified time from the rising.

Figure 11:
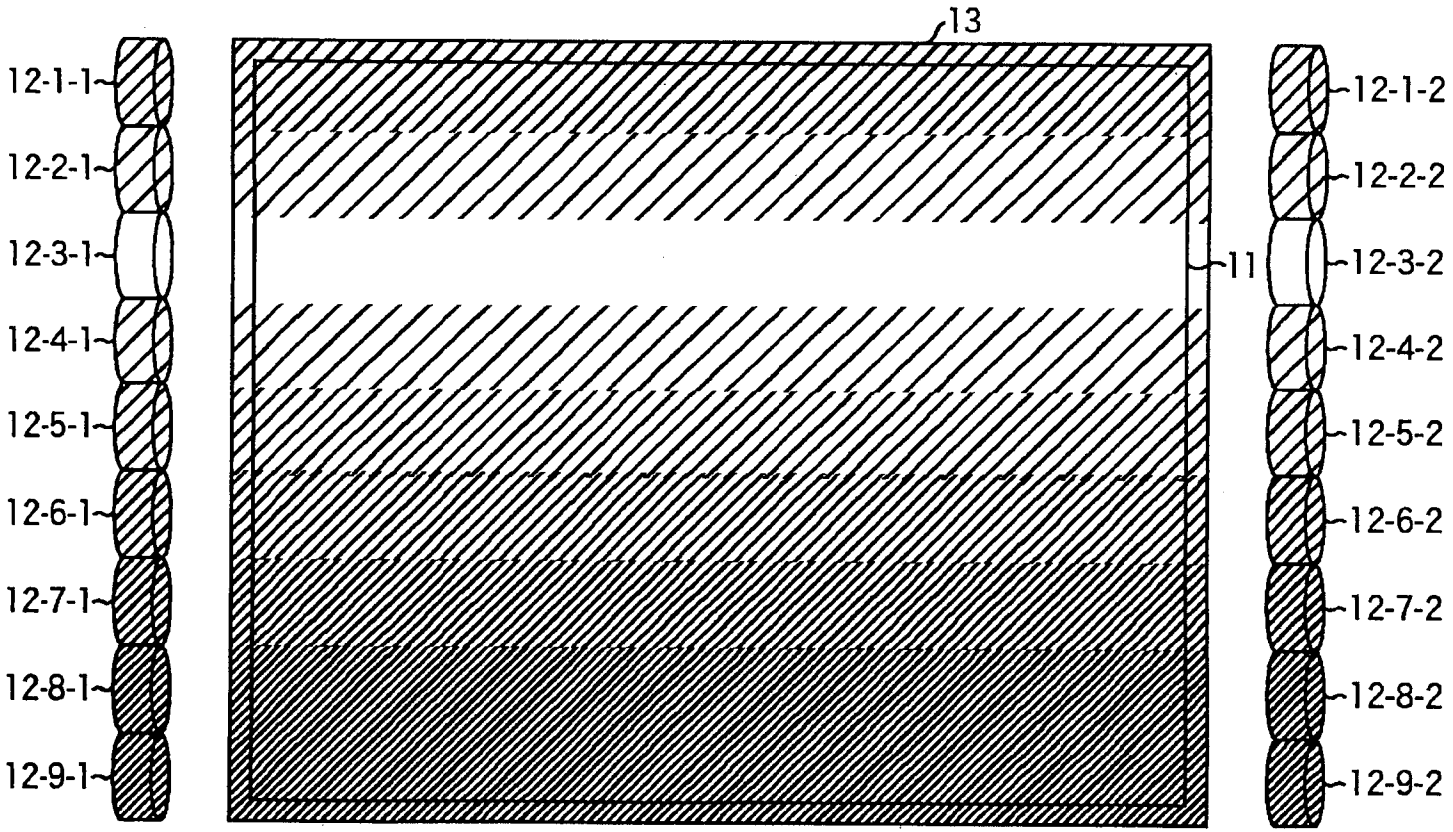
FIG. 11 is an explanatory diagram of an example of light emission of the LED backlights.
Figure 12:
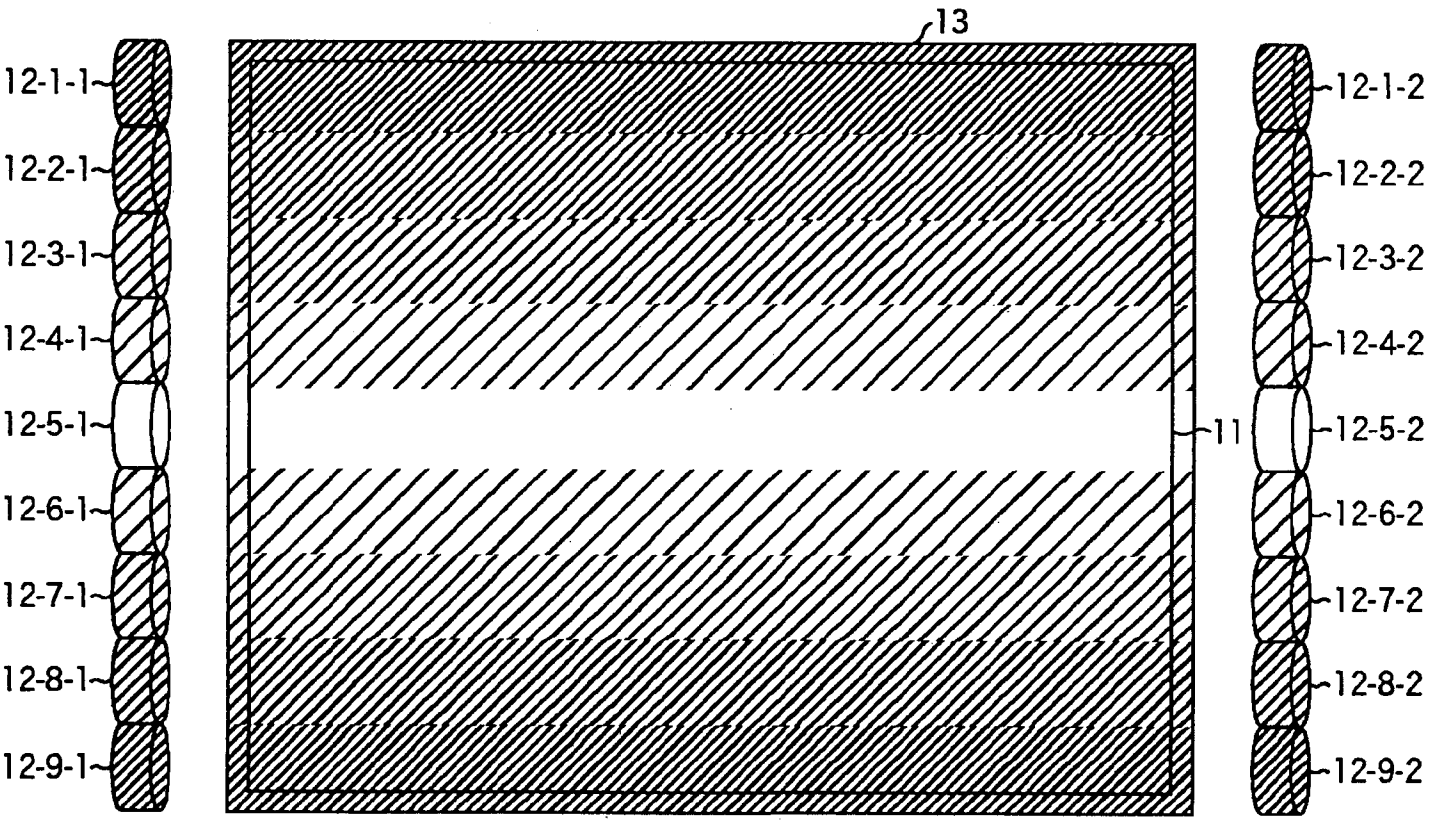
FIG. 12 is an explanatory diagram of an example of light emission of the LED backlights.

Referring to FIGS. 11 and 12, examples of the light emission of the LED backlights 12-1-1 to 12-9-2 will be described in which the light-emitting signals 1 to N rise such that they increase in value exponentially and then attenuates exponentially with the passage of time after a lapse of a specified time from the rising.

As shown in FIG. 11, when a specified time has passed from the frame-starting time, the LED backlights 12-3-1 and 12-3-2 of the LED backlights 12-1-1 to 12-9-2 emit light at the maximum brightness; the LED backlights 12-2-1, 12-2-2, 12-4-1, and 12-4-2 emit light at a brightness next to that of the LED backlights 12-3-1 and 12-3-2; and the LED backlights 12-1-1, 12-1-2, 12-5-1, and 12-5-2 emit light at a brightness next to that of the LED backlights 12-2-1, 12-2-2, 12-4-1, and 12-4-2.

The LED backlights 12-6-1 and 12-6-2 emit light at a brightness next to that of the LED backlights 12-1-1, 12-1-2, 12-5-1, and 12-5-2; the LED backlights 12-7-1 and 12-7-2 emit light at a brightness next to that of the LED backlights 12-6-1 and 12-6-2; and the LED backlights 12-8-1, 12-8-2, 12-9-1, and 12-9-2 emit light at a brightness next to that of the LED backlights 12-7-1 and 12-7-2.

In other words, the LCD 11 is illuminated strongly in the region closer to a virtual horizontal axis connecting the LED backlights 12-3-1 and 12-3-2, and is illuminated weakly in the region distant from the horizontal axis by the LED backlights 12-1-1 to 12-9-2.

As shown in FIG. 12, when a specified time has passed from the time shown in FIG. 11, the LED backlights 12-5-1 and 12-5-2 of the LED backlights 12-1-1 to 12-9-2 emit light at the maximum brightness; the LED backlights 12-4-1, 12-4-2, 12-6-1, and 12-6-2 emit light at a brightness next to that of the LED backlights 12-5-1 and 12-5-2; and the LED backlights 12-3-1, 12-3-2, 12-7-1, and 12-7-2 emit light at a brightness next to that of the LED backlights 12-4-1, 12-4-2, 12-6-1, and 12-6-2.

The LED backlights 12-2-1, 12-2-2, 12-8-1, and 12-8-2 emit light at a brightness next to that of the LED backlights 12-3-1, 12-3-2, 12-7-1, and 12-7-2; the LED backlights 12-1-1, 12-1-2, 12-9-1, and 12-9-2 emit light at a brightness next to that of the LED backlights 12-2-1, 12-4-2, 12-8-1, and 12-8-2.

In other words, the LCD 11 is illuminated strongly in the region closer to a virtual horizontal axis connecting the LED backlights 12-5-1 and 12-5-2, and is illuminated weakly in the region distant from the horizontal axis by the LED backlights 12-1-1 to 12-9-2.

Figure 13:
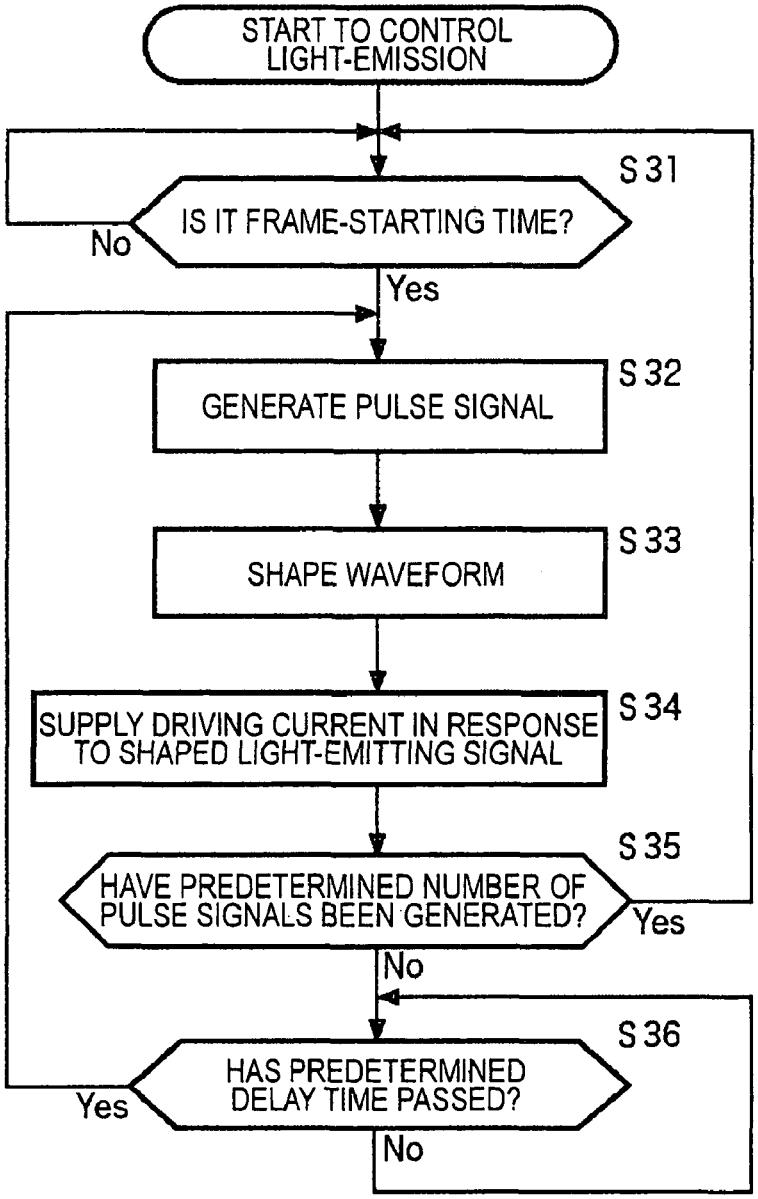
FIG. 13 is a flowchart for another process of controlling the light emission.

Referring now to the flowchart of FIG. 13, the process of controlling the light emission of the display device according to the invention will be described in the case where the LED backlights 12-1 to 12-N are lit so as to increase or decrease in brightness temporally continuously. Since the processes of steps S31 and 32 are the same as those of steps S11 and S12 of FIG. 7, respectively, descriptions thereof will be omitted.

In step S33, the CR circuits 91-1 to 91-N shape the pulse signals 1 to N, respectively. For example, in step S33, the CR circuits 91-1 to 91-N receive the pulse signals 1 to N supplied from the pulse-signal generating section 42, respectively, and shape the received pulse signals 1 to N so as to increase or decrease the values temporally continuously.

For example, in step S33, the CR circuits 91-1 to 91-N shape the pulse signals 1 to N supplied from the pulse-signal generating section 42 by differentiating them, respectively. For example, in step S33, the CR circuits 91-1 to 91-N shape the pulse signals 1 to N supplied from the pulse-signal generating section 42, respectively, such that they rise so as to increase in value exponentially, and attenuate exponentially with the passage of time after a specified time from the rising.

Then the CR circuits 91-1 to 91-N output the shaped pulse signals 1 to N as light-emitting signals 1 to N, respectively.

In step S34, the current-control sections 43-1 to 43-N convert the light-emitting signals 1 to N supplied from the CR circuits 91-1 to 91-N to the driving currents 1 to N, respectively, and supply the converted driving currents 1 to N to the LED backlights 12-1 to 12-N, respectively. In this way, the current-control sections 43-1 to 43-N control the light emission of the LED backlights 12-1 to 12-N, respectively.

Figure 7:
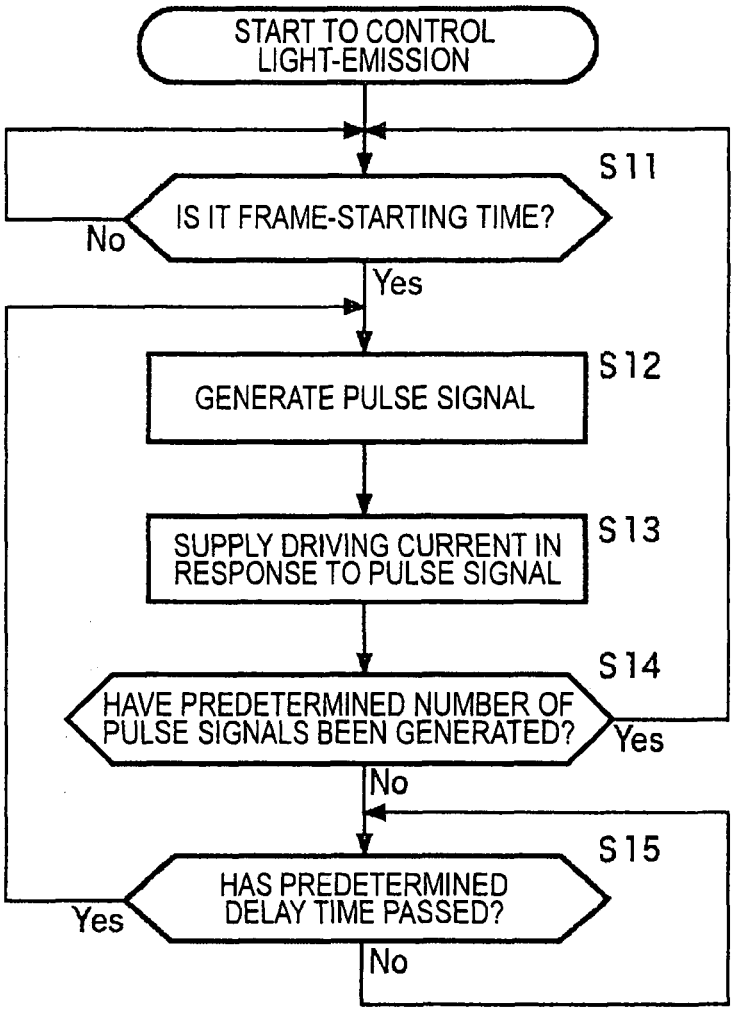
FIG. 7 is a flowchart for a process of controlling the light emission.

Since the processes of steps S35 and 36 are the same as those of steps S14 and 15 of FIG. 7, descriptions thereof will be omitted.

The light source is not limited to the LED, but may be a light source that can change in brightness in a time shorter than the period of the frame, such as an electroluminescence (EL) device.

The light source may be a light source that varies in brightness cyclically.

Figure 14:
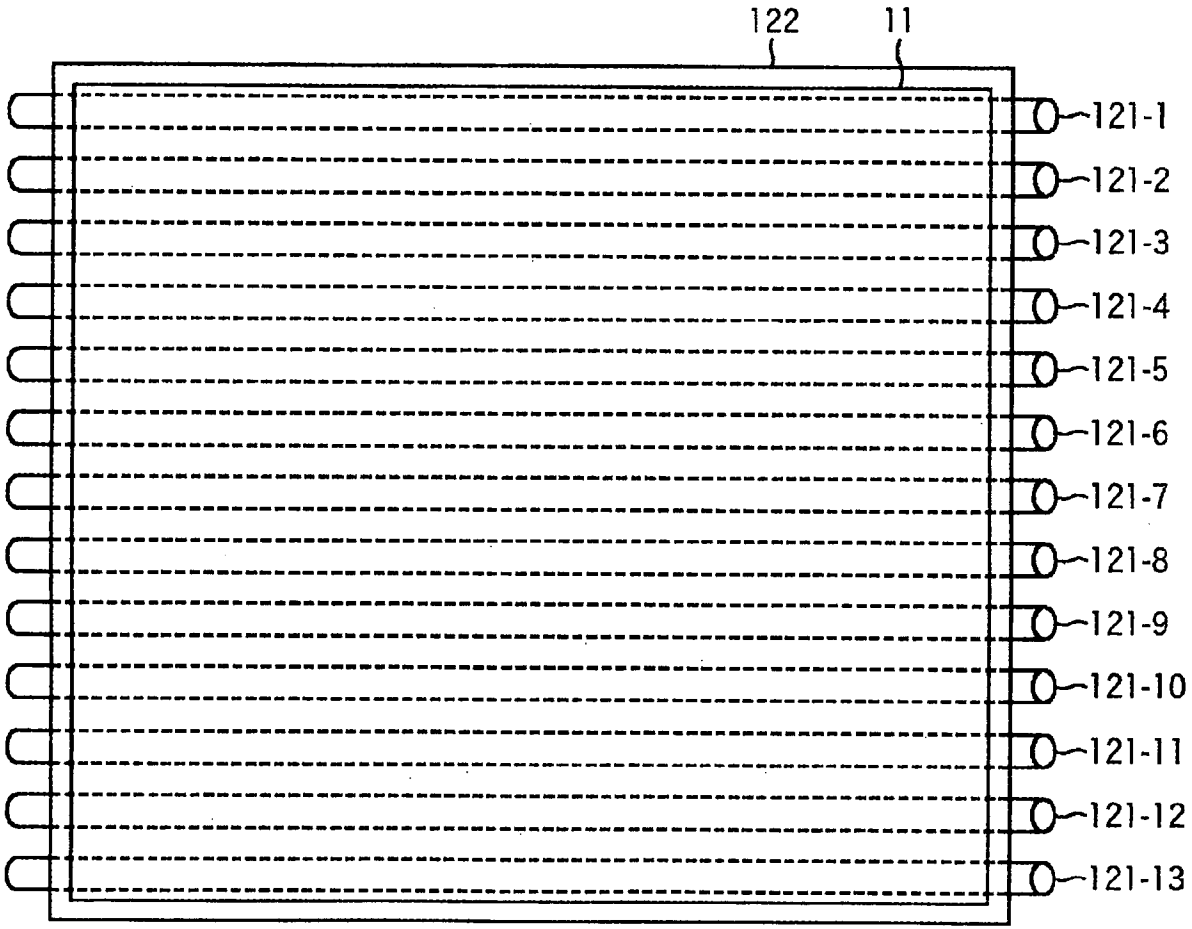
FIG. 14 is a diagram showing a configuration of a display device according to another embodiment of the invention.

FIG. 14 is a diagram showing the configuration of a display device using a cold-cathode tube as alight source, according to another embodiment of the invention. The same components as those of FIG. 1 are given the same reference numerals and descriptions thereof will be omitted here.

Cold-cathode tubes 121-1 to 121-13 are examples of the light source of the display device. The light emitted from the cold-cathode tubes 121-1 to 121-13 is diffused evenly by a diffuser 122 into the back of the LCD 11. The light incident on the back of the LCD 11 passes through the LCD 11 into the eyes of a person who is viewing the LCD 11.

The cold-cathode tube 121-1 illuminates the pixels in one or a plurality of upper rows of the LCD 11 in FIG. 14, out of all the rows on the screen, from the back of the LCD 11. Here the row is the unit of update of the display. The cold-cathode tube 121-2 illuminates the pixels in one or a plurality of rows lower than those illuminated by the cold-cathode tube 121-1, out of all the rows of the screen of the LCD 11 in FIG. 14, from the back of the LCD 11. The row is the unit of update of the display. The cold-cathode tube 121-3 illuminates the pixels in one or a plurality of rows lower than those illuminated by the cold-cathode tube 121-2, out of all the rows of the screen of the LCD 11 in FIG. 14, from the back of the LCD 11. The row is the unit of update of the display.

Likewise, the cold-cathode tubes 121-4 to 121-13 illuminate the pixels in part of the rows out of all the rows on the screen of the LCD 11, from the back of the LCD 11. Here the row is the unit of update of the display.

When there is no need to distinguish the cold-cathode tubes 121-1 to 121-13 from one another, they are simply referred to as cold-cathode tubes 121.

The number of the cold-cathode tubes 121 is not limited to 13, but may be an arbitrary number N. In this case, the cold-cathode tubes 121 are referred to as cold-cathode tubes 121-1 to 121-N to discriminate one from another.

Figure 15:
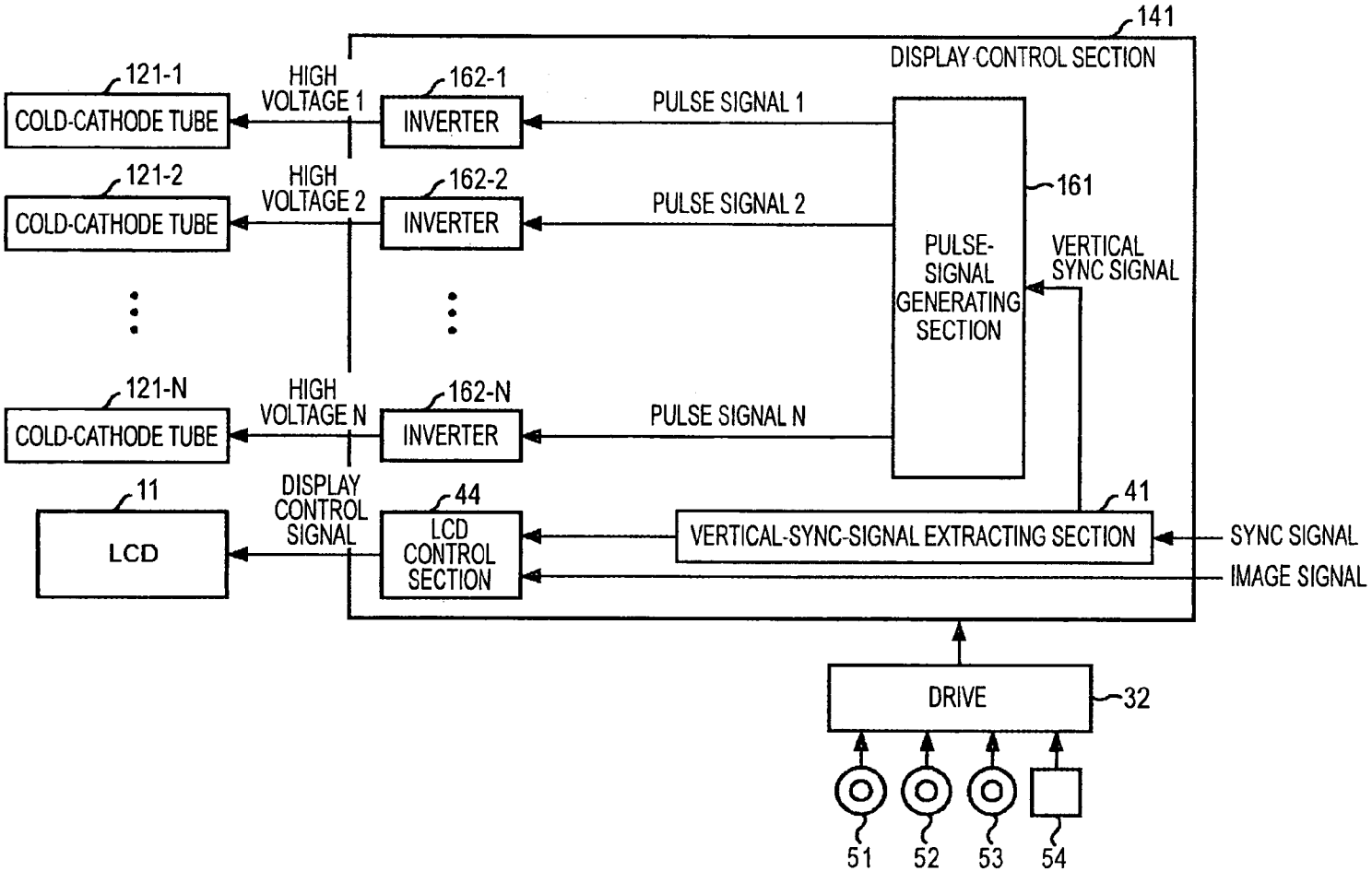
FIG. 15 is a block diagram showing a configuration of the display device according to another embodiment of the invention.

FIG. 15 is a block diagram showing another configuration of the display device having a cold-cathode tube as a light source, according to the invention. The same components as those of FIG. 2 are given the same reference numerals and descriptions thereof will be omitted here.

A display control section 141 controls the display of the LCD 11 and the light emission of the cold-cathode tubes 121-1 to 121-N that are examples of the light source. The display control section 141 is achieved by a dedicated circuit such as an ASIC, a programmable LSI such as an FPGA, or a general-purpose microprocessor that executes a control program.

The display control section 141 includes the vertical-sync-signal extracting section 41, the LCD control section 44, a pulse-signal generating section 161, and inverters 162-1 to 162-N.

The pulse-signal generating section 161 generates pulse signals for indicating the timing of the change of the brightness of the cold-cathode tubes 121-1 to 121-N in synchronization with the vertical sync signal. For example, the pulse-signal generating section 161 generates pulse signals 1 to N that are delayed in accordance with the number N of the cold-cathode tubes 121-1 to 121-N with reference to the time after a lapse of a specified offset time from the frame-starting time on the basis of the vertical sync signal.

Here the pulse signal 1 is a signal for indicating the timing of changing the brightness of the cold-cathode tube 121-1. The pulse signal 2 is a signal for indicating the timing of changing the brightness of the cold-cathode tube 121-2. The pulse signal 3 (not shown) to the pulse signal N are signals for indicating the timing of changing the brightness of the cold-cathode tube 121-3 (not shown) to the cold-cathode tube 121-N, respectively.

The pulse-signal generating section 161 supplies the generated pulse signals 1 to N to the inverters 162-1 to 162-N, respectively.

The inverter 162-1 generates a high voltage 1 that is an alternating voltage with the same cycle as the period of the frame with reference to the time indicated by the pulse signal 1 supplied from the pulse-signal generating section 161, and supplies the generated high voltage 1 to the cold-cathode tube 121-1, thereby lighting the cold-cathode tube 121-1, and controlling the timing of the light emission of the cold-cathode tube 121-1. The inverter 162-2 generates a high voltage 2 that is an alternating voltage with the same cycle as the period of the frame with reference to the time indicated by the pulse signal 2 supplied from the pulse-signal generating section 161, and supplies the generated high voltage 2 to the cold-cathode tube 121-2, thereby lighting the cold-cathode tube 121-1, and controlling the timing of the light emission of the cold-cathode tube 121-2.

The inverters 162-3 to 162-N generate high voltages 3 to N that are alternating voltages with the same cycle as the period of the frame, with reference to the time indicated by the pulse signals 3 to N supplied from the pulse-signal generating section 161, and supply the generated high voltages 3 to N to the cold-cathode tubes 121-3 to 121-N, thereby lighting the cold-cathode tubes 121-3 to 121-N, and controlling the timing of the light emission of the cold-cathode tubes 121-3 to 121-N, respectively.

Figure 16:
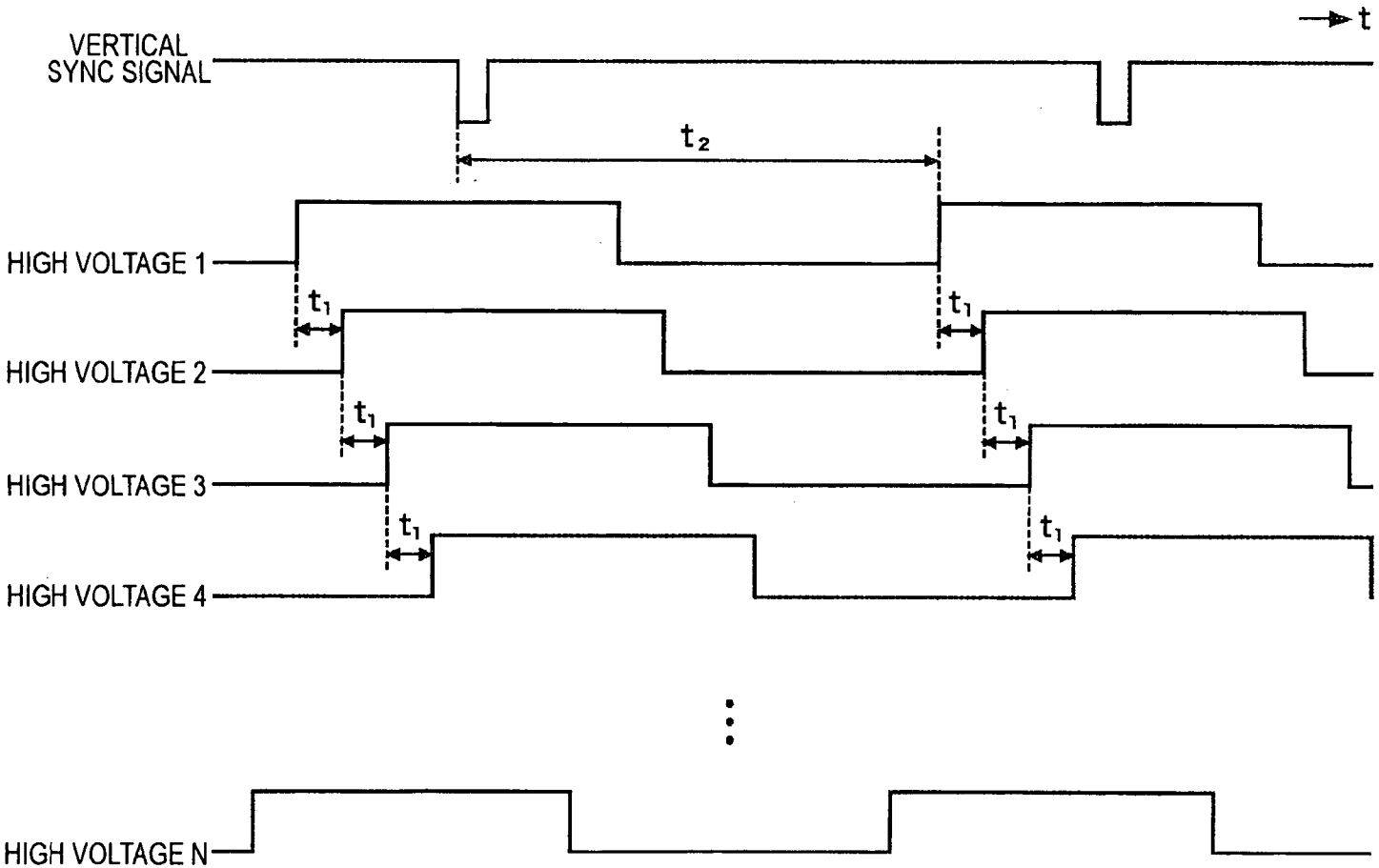
FIG. 16 is a diagram showing an example of high voltages 1 to N.

FIG. 16 is a diagram showing an example of the high voltages 1 to N.

As shown in FIG. 16, the high voltage 1 is an alternating voltage in which the frame-starting time agrees with the time in the center of the period during which the high voltage 1 is positive.

Referring to FIG. 16, the time from the frame-starting time to the time at which the high voltage 1 becomes positive is referred to as offset time t2.

The high voltage 2 is an alternating voltage in which the time after a lapse of delay time t1 from the frame-starting time agrees with the time in the center of the period during which the high voltage 2 is positive.

The high voltages 3 to N are alternating voltages in which the time after a lapse of the integer times as long as the delay time t1 from the frame-starting time agrees with the time in the center of the period during which the high voltage is positive.

That is, the high voltages 1 to N are alternating voltages in which the time delayed from the frame-starting time in accordance with the number of the cold-cathode tubes 121-1 to 121-N agrees with the time in the center of the period during which the high voltage is positive.

For example, the pulse-signal generating section 161 generates the pulse signal 1 at the time after a lapse of an offset time from the frame-starting time, and thereafter generates pulse signals 2 to N every time the delay time t1 elapses. The inverters 162-1 to 162-N generate the high voltages 1 to N, respectively, in a manner such that the voltages become positive when any of the pulse signals 1 to N supplied from the pulse-signal generating section 161 rises.

More specifically speaking, the pulse signal 1 is generated so that the cold-cathode tube 121-1 is given the maximum voltage at the frame-starting time; the pulse signal 2 is generated so that the cold-cathode tube 121-2 is given the maximum voltage at the time after a lapse of delay time t1 from the frame-starting time; and the pulse signal 3 is generated so that the cold-cathode tube 121-3 is given the maximum voltage at the time after a lapse of twice as long as delay time t1 from the frame-starting time. Likewise, for the cold-cathode tubes 121-4 to 121-N, the pulse signals 4 to N are generated so that the power becomes the maximum at the time after a lapse of a period corresponding to the number of the cold-cathode tubes 121-1 to 121-N from the frame-starting time.

Thus the cold-cathode tube 121-1 emits light so as to have the maximum brightness at the frame-starting time; the cold-cathode tube 121-2 emits light so as to have the maximum brightness at the time after a lapse of delay time t1 from the frame-starting time; and the cold-cathode tube 121-3 emits light so as to have the maximum brightness at the time after a lapse of twice as long as delay time t1 from the frame-starting time. Likewise, the cold-cathode tubes 121-4 to 121-N emit light so as to have the maximum brightness at the time after a lapse of a period corresponding to the number of the cold-cathode tubes 121-1 to 121-N from the frame-starting time.

Consequently, the cold-cathode tubes 121-1 to 121-N can illuminate the pixels of the LCD 11 updated, in the respective period of the frame.

When there is no need to distinguish the cold-cathode tubes 121-1 to 121-N from one another, they are simply referred to as cold-cathode tubes 121. When there is no need to distinguish the inverters 162-1 to 162-N from one another, they are simply referred to as inverters 162.

Figure 17:
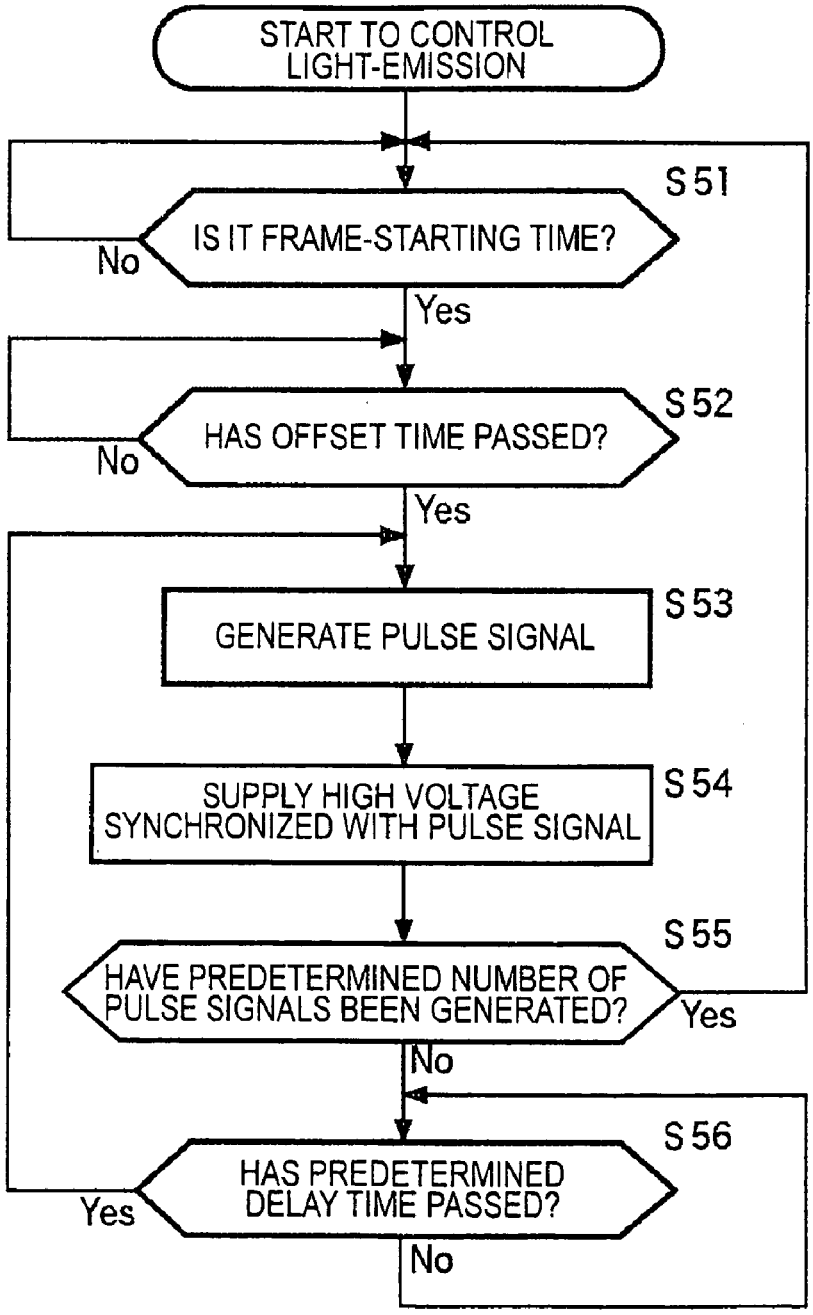
FIG. 17 is a flowchart for another process of controlling the light emission.

Referring to the flowchart of FIG. 17, another process of controlling the light emission of the display device having a cold-cathode tube as the light source according to the invention will be described. The process of the flowchart of FIG. 17 is executed in parallel for the frames.

Since the process of step S51 is the same as that of step S11 of FIG. 7, a description thereof will be omitted here.

In step S52, the pulse-signal generating section 161 determines on the basis of the vertical sync signal whether offset time t2 has passed from the frame-starting time. When it is determined that the offset time t2 has not passed from the frame-starting time, the procedure returns to step S52, where the process of determination from the frame-starting time until the offset time t2 passes.

In this case, for example, the offset time t2 is set to three quarters of the period of the frame. Specifically, when the period of high voltage during which the cold-cathode tube is lit is the same as the period of the frame, the period during which high voltage for lighting the cold-cathode tube is positive is one half of the period of the frame. The period from the time when the high voltage for lighting the cold-cathode tube becomes positive to the time in the center of the period during which the high voltage is positive is one quarter of the period of the frame.

The pulse signal indicates the timing at which the high voltage for lighting the cold-cathode tube becomes positive. Accordingly, in order to make the time in the center of the period during which the high voltage is positive coincident with the frame-starting time, the difference when the period from the time that the high voltage for lighting the cold-cathode tube becomes positive to the time in the center of the period during which the voltage is positive is subtracted from the period of the frame is set to offset time t2.

In step S52, when it is determined that offset time t2 has passed from the frame-starting time, the process proceeds to step S53, where the pulse-signal generating section 161 generates a pulse signal. In step S54, the inverter 162 supplies a high voltage synchronized with the pulse signal generated by the process of step S53 to the cold-cathode tubes 121.

Since the processes of steps S55 and S56 are the same as those of steps S14 and 15 in FIG. 7, descriptions thereof will be omitted here.

The cold-cathode tubes 121 are lit at the maximum brightness in sequence at the time delayed in accordance with the number of the cold-cathode tubes 121 with reference to the time after a lapse of offset time t2 from the frame-starting time in consideration of the timing at which the cold-cathode tubes 121 have the maximum brightness.

Accordingly, the cold-cathode tubes 121 illuminate the pixels of the LCD 11 updated in sequence from the back.

Accordingly, also with a cold-cathode tube as the light source, a moving image can be displayed with less double vision.

The invention can be applied not only to display devices that display moving images by a what-is-called progressive system, but also to display devices that display moving images by a what-is-called interlace system.

The display devices include devices having a display function and other functions, such as what-is-called notebook personal computers, personal digital assistants (PDAs), mobile phones, and digital video cameras.

As described above, when the light sources are lit at a specified brightness during the period of the frame, images can be displayed. When display means updates the display in the order of the columns or rows in each period of the frame, in units of the pixels in the column or row of the screen, when multiple light sources illuminate the pixels of the display means so as to illuminate part of all the columns or rows of the screen, and when the light sources are controlled so as to illuminate the pixels updated in sequence, respectively, in sequence, the display device can display a moving image with less double vision.

The series of processes described above can be achieved by either hardware or software. With software, the processes are achieved by a computer that incorporates a program that configures the software in dedicated hardware, or a general-purpose personal computer that can perform various functions with various programs installed from a recording medium.

AS shown in FIGS. 2, 8, and 15, examples of the recording medium include not only package media distributed to a user to provide a program, separately from the computer, such as a magnetic disk 51 (including flexible disks), an optical disk 52 (including compact disc read-only memories (CD-ROMs) and digital versatile discs (DVDs), a magneto-optical disk 53 (including Mini-Discs (MDs, registered trademark)), or a semiconductor memory 54, but also ROMs and hard disks in which programs are recorded, which are provided to the user in a state in which they are incorporated in computers in advance.

The program for achieving the series of processes described above may be installed in computers via interfaces such as routers or modems, or cable or radio communication media such as local area networks, the Internet, or digital broadcasting.

The step of describing a program to be stored in a recording medium in this specification includes not only time-series processes executed in the described order but also processes executed not in a time series but in parallel or separately.

The invention claimed is:

1. A display device comprising:

display means that updates the display in the order of the columns or rows of pixels on the screen in units of column or row in each period of a frame;

a plurality of light sources illuminating the pixels of the display means, respectively, so as to illuminate the columns or rows of pixels on the screen consistent with the order of the display update; and control means controlling the light emission of the light sources in a manner such that the light sources illuminate the pixels updated in sequence in each period of the frame, wherein the control means comprises:

sync-signal generating means generating a sync signal for synchronization with the frame;

light-emission-indication-signal generating means generating a plurality of light-emission indication signals for the light sources on the basis of the sync signal, respectively, the light-emission indication signals being respectively delayed from the frame-starting time according to a delay time that is dependent upon the period of the frame and the number of the light sources; and a plurality of light-emission control means controlling the light emission of the light sources in response to the light-emission indication signals on a one-to-one basis, wherein the delay time is equal to $(k-1)/(M*N)$, where M is a frame rate corresponding to the period of the frame, N is the number of light sources, and k is the kth of the plurality of light-emission indication signals.

2. The display device according to claim 1, wherein the control means further comprises waveform shaping means that shapes the waveform of the light-emission indication signals so that the values of the light-emission indication signals change with the passage of time; and the light-emission control means controls the light emission of the light sources so as to change the intensity of the light emission of the light sources in accordance with the values of the shaped light-emission indication signals.

3. The display device according to claim 2, wherein the waveform shaped by the waveform shaping means reaches the maximum height at the rising, and attenuates exponentially, or decreases monotonously, with the passage of time.

4. The display device according to claim 2, wherein the light-emission-indication-signal generating means generates a plurality of light-emission indication signals for the light sources, respectively, the light-emission indication signals being delayed in accordance with the number of the light sources with reference to the time after a lapse of a specified time from the frame-starting time.

5. The display device according to claim 1, wherein the light-emission-indication-signal generating means generates the plurality of light-emission indication signals for the light sources, respectively, the light-emission indication signals being delayed in accordance with the number of the light sources with reference to the time after a lapse of a specified time from the frame-starting time.

6. A display method for a display device that comprises a display means that updates the display in the order of the columns or rows of pixels on the screen in units of column or row in each period of a frame, and a plurality of light sources illuminating the pixels of the display means, respectively, so as to illuminate the columns or rows of pixels on the screen consistent with the order of the display update, the method comprising:

controlling the light emission of the light sources in a manner such that the light sources illuminate the pixels updated in sequence in each period of the frame;

generating a sync signal for synchronization with the frame;

generating a plurality of light-emission indication signals for the light sources on the basis of the sync signal, respectively, the light-emission indication signals being respectively delayed from the frame-starting time according to a delay time that is dependent upon the period of the frame and the number of the light sources; and controlling the light emission of the light sources in response to the light-emission indication signals, wherein the delay time is equal to (k−1)/(M*N), where M is a frame rate corresponding to the period of the frame, N is the number of light sources, and k is the kth of the plurality of light-emission indication signals.

7. A non-transitory computer readable medium in which a computer-readable program is recorded, the program containing instructions executable by a processor to perform operations comprising:

controlling the display of a display device that comprises display means that updates the display in the order of the columns or rows of pixels on the screen in units of column or row in each period of a frame, and a plurality of light sources illuminating the pixels of the display means, respectively, so as to illuminate the columns or rows of pixels on the screen consistent with the order of the display update;

controlling the light emission of the light sources in a manner such that the light sources illuminate the pixels updated in sequence in each period of the frame;

generating a sync signal for synchronization with the frame;

generating a plurality of light-emission indication signals for the light sources on the basis of the sync signal, respectively, the light-emission indication signals being respectively delayed from the frame starting time according to a delay time that is dependent upon the period of the frame and the number of the light sources; and controlling the light emission of the light sources in response to the light-emission indication signals, wherein the delay time is equal to (k−1)/(M*N), where M is a frame rate corresponding to the period of the frame, N is the number of light sources, and k is the kth of the plurality of light-emission indication signals.

* * * * *